United States Patent [19]

Takada et al.

[11] Patent Number: 4,820,614

[45] Date of Patent: Apr. 11, 1989

[54] SILVER HALIDE PHOTOGRAPHIC LIGHT-SENSITIVE MATERIAL SUITABLE FOR RAPID PROCESSING

[75] Inventors: Shun Takada; Kazuhiro Murai; Kaoru Onodera, all of Odawara, Japan

[73] Assignee: Konica Corporation, Tokyo, Japan

[21] Appl. No.: 121,473

[22] Filed: Nov. 17, 1987

[30] Foreign Application Priority Data

Nov. 19, 1986 [JP] Japan ..... 61-276082

[51] Int. Cl.[4] ..... G03C 7/20; G03C 7/34

[52] U.S. Cl. ..... 430/505; 430/549; 430/551

[58] Field of Search ..... 430/549, 551, 505

[56] References Cited

U.S. PATENT DOCUMENTS 3,336,135 8/1967 Terashima et al. ..... 430/551

4,666,826 5/1987 Takada et al. ..... 430/551

*Primary Examiner*—Richard L. Schilling

*Attorney, Agent, or Firm*—Jordan B. Bierman

[57] ABSTRACT

A silver halide photographic light sensitive material improved in suitability for rapid processing and in color forming efficiency, spectral absorption property and fastness of the cyan image is disclosed. The silver halide photographic light-sensitive material comprises a support having thereon at least one silver halide emulsion layer comprising a silver halide grain containing 90 mol % or more of silver chloride, a cyan- dye forming coupler represented by the following formula [C-1], a cyan-dye forming coupler represented by the following formula [C-2], and a non-color forming compound represented by the following formula [I]; and a compound represented by the following formula [IIa], [IIb] or [IIc]:

Formula [C-1]

Formula [C-2]

Formula [I]

Formula [IIa]

Formula [IIb]

Formula [IIc]

15 Claims, No Drawings

SILVER HALIDE PHOTOGRAPHIC LIGHT-SENSITIVE MATERIAL SUITABLE FOR RAPID PROCESSING

FIELD OF THE INVENTION

This invention relates to a silver halide photographic light-sensitive material suitable for rapid processing.

BACKGROUND OF THE INVENTION

In recent years, in the photographic industry, there have been the demands for silver halide photographic light-sensitive materials which are excellent in image quality and can be rapidly processed.

Usually, in the development of silver halide photographic light-sensitive materials, a number of the light-sensitive materials are continuously processed with an automatic processor installed at each photofinishing laboratory. On the other hand, as one of the improvements of customer service, the same day service has been demanded and, recently, the service within several hours from the receipt of photofinishing orders has further been demanded. Thus, the rapid processing is getting indispensable day by day. Also, the developments of rapid processing have been urgently demanded from the viewpoints that the shortening of processing time leads to the improvement of service efficiency and the processing cost can be reduced.

Accordingly, various approaches to the achievement of rapid processing have been made from the two aspects of light-sensitive materials and processing liquids. Namely, in color developing processes, there have been known that the attempts of making higher a temperature, pH, concentration of color developing agents or the like have been made and additives such as a development accelerator and the like have been added in the color processing processes. Such development accelerators include 1-phenyl-3-pyrazolidone described in British Pat. No. 811,185, N-methyl-p-aminophenol described in U.S. Pat. No. 2,417,514, N,N,N',N'-tetramethyl-p-phenylenediamine described in Japanese Patent Publication Open to Public Inspection (hereinafter referred to as Japanese Patent O.P.I. Publication) No. 15554-1975 and so forth. In these methods, however, any satisfactory rapid-processability has not been achieved, but such a performance deterioration as fog increase and so forth has mostly been induced.

On the other hand, in the silver halide emulsions used in light-sensitive materials, it has been known that the configurations, sizes and compositions of silver halide grains and, particularly, the composition of silver halides greatly influences the development rates of the light-sensitive materials and so forth. It has also particularly known that a remarkably high development rate can be displayed when using a silver halide highly containing silver chloride.

For the dye image quality obtained from a silver halide photographic light-sensitive material, it is required to be excellent in color developability, color reproducibility and anti-fading property of long standing.

The present inventors have studied rapid processings by making use of the above-mentioned silver halide highly containing silver chloride, which is suitable for a rapid processing, and combining various types of cyan couplers with each other.

When using the combination of a silver halide highly containing silver chloride and a phenol type cyan coupler having an alkyl group in the 5th position, which has so far widely been used as a cyan coupler, a rapid processing was achieved. However, there is a problem that an anti-dark-fading property was deteriorated; the cyan dye was formed to be excellent in tone and light-fastness, though. In order to improve such anti-dark-fading property, there is available a method of using a phenol type cyan coupler having an alkyl group in the 5th position together with a 2,5-diacylaminophenol type cyan coupler. In this method, color developability, light-fastness and tone are deteriorated; an anti-dark-fading property may be improved, though. In order to improve light-fastness, there is available a method in which a UV absorber is used. And, in order to improve tones, there is available a method in which urea or a sulfamide compound is used, as described in, for example, Japanese Patent O.P.I. Publication No. 204041-1984. When using the UV absorber, color developability is further detriorated; the above-mentioned cyan dye light-fastness deteriorated by making combination use of the two kinds of cyan couplers may be improved, though. Also, when using the urea or a sulfamide compound, anti-dark-fading property is deteriorated; the above-mentioned cyan dye tone deteriorated by making combination use of the two kinds of cyan couplers may be improved, though.

As mentioned above, in any conventional technologies, there has not been available any silver halide photographic light-sensitive material suitable for rapid processings and capable of forming high quality cyan dye images.

SUMMARY OF THE INVENTION

It is, therefore, an object of the invention to provide a silver halide photographic light-sensitive material suitable for a rapid processing.

Another object of the invention is to provide a silver halide photographic light-sensitive material which is excellent in color developability and spectral absorption characteristics of cyan dyes formed therein and is also excellent in anti-fasing property thereof.

The above-mentioned objects of the invention can be achieved by providing a silver halide photographic light-sensitive material comprising a support having thereon at least one silver halide emulsion layer containing silver halide grains having a silver chloride content of not less than 90 mol%, cyan-dye forming couplers represented by the following formulas [C-1] and [C-2], respectively, a non-color forming compound represented by the following formula [I], and at least one compound selected from the group consisting of the compounds represented by the following formulas [IIa], [IIb] and [IIc], respectively.

Formula [C-1]

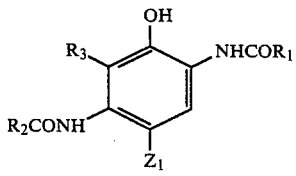

wherein $R_1$ and $R_2$ are an alkyl group, a cycloalkyl group, an alkenyl group, an aryl group or a heterocyclic group, respectively; $R_3$ is a hydrogen atom, a halogen atom, an alkyl group or an alkoxy group, provided that $R_2$ and $R_3$ are allowed to complete a ring, between them; and $Z_1$ is a hydrogen atom or a group capable of being split off upon reaction with the oxidized product of a color developing agent.

Formula [C-2]

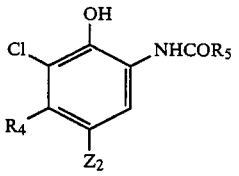

wherein $R_4$ is an alkyl group; $Z_2$ is a hydrogen atom or a group capable of being split off upon reaction with the oxidized product of a color developing agent; and $R_5$ is a ballast group.

Formula [I]

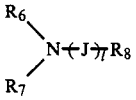

wherein $R_6$ and $R_7$ are a hydrogen atom, an alkyl group, an aryl group or a heterocyclic group, respectively; $R_8$ is an alkyl group, an aryl group, a cyano group or a heterocyclic group; J is an $—SO_2—$ group, an —SO— group, a —COO— group, a —CO— group, a —CS— group, an

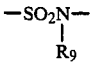

group, or a

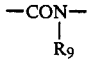

group, in which $R_9$ is a hydrogen atom, an alkyl group, an aryl group or a heterocyclic group; and l is an integer of zero or one. In the formula, either one of $R_6$ and $R_7$ is allowed to couple to $R_8$ so as to complete a ring.

Formula [IIa]

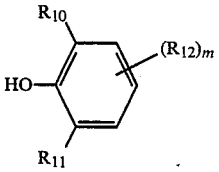

wherein $R_{10}$ and $R_{11}$ are an alkyl group, respectively; $R_{12}$ is an alkyl group, an $—NHR'_{12}$ group, an $—SR'_{12}$ group (in which $R'_{12}$ is a monovalent organic group) or a $—COOR''_{12}$ group (in which $R''_{12}$ is a hydrogen atom or a monovalent organic group.); and m is a integer of from zero to three.

Formula [IIb]

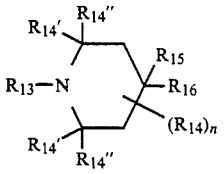

wherein $R_{13}$ is a hydrogen atom, a hydroxyl group, an oxyradical group, an $—SOR'_{13}$ group, an $—SO_2R'_{13}$ group (in which $R'_{13}$ is an alkyl group or an aryl group), an alkyl group, an alkenyl group, an alkinyl group, or a $—COR''_{13}$ group (in which $R''_{13}$ is a hydrogen atom or a monovalent organic group.); $R_{14}$, $R'_{14}$ and $R''_{14}$ are an alkyl group, respectively; $R_{15}$ and $R_{16}$ are a hydrogen atom or an —OCOR''' group (in which R''' is a monovalent organic group), provided that $R_{15}$ and $R_{16}$ are allowed to complete a heterocyclic ring, between them; and n is an integer of from zero to four.

Formula [IIc]

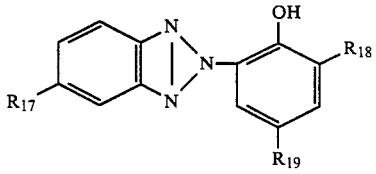

wherein $R_{17}$, $R_{18}$ and $R_{19}$ are a hydrogen atom, a halogen atom, a hydroxyl group, a nitro group, an alkyl group, an aryl group, an alkoxy group, an aryloxy group or an alkenyl group, respectively.

DETAILED DESCRIPTION OF THE INVENTION

Now, the cyan couplers represented by the above-given formula [C-1], which can be used in this invention, will be explained.

In Formula [C-1], the alkyl groups represented by $R_1$ or $R_2$ include, for example, those having 1 to 32 carbon atoms; the alkenyl groups include, for example, thos having 2 to 32 carbon atoms; and the cycloalkyl groups include, for example, those having 3 to 12 carbon atoms. Such alkyl groups and alkenyl groups may be those either straight-chained or branched. These alkyl, alkenyl and cycloalkyl groups also include those having a substituent, respectively.

The aryl groups represented by $R_1$ or $R_2$ should preferably be a phenyl group including those having a substituent.

The heterocyclic groups represented by $R_1$ or $R_2$ should preferably be 5- to 7-membered and may further be either substituted or condensed.

$R_1$ is preferably a phenyl group substituted with a halogen atom.

$R_3$ represents a hydrogen atom, a halogen atom, an alkyl group or an alkoxy group and preferably a hydrogen atom.

The rings completed by and between $R_2$ and $R_3$ are preferably a 5- to 6-membered ring.

In Formula [C-1], the groups, which are represented by $Z_1$ and are capable of being split off upon reaction with the oxidized product of a color developing agent, include a halogen atom, an alkoxy group, an aryloxy group, an acyloxy group, a sulfonyloxy group, an acylamino group, a sulfonylamino group, an alkoxycarbonyloxy group, an imido group and so forth and, preferably, a halogen atom, an aryloxy group and an alkoxy group.

The typical examples of the cyan couplers represented by Formula [C-1] [hereinafter called Cyan coupler (1) of the invention] will be given below:

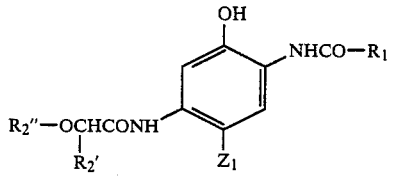

| Exemplified Cyan coupler No. | $R_1$ | $Z_1$ | $R_2'$ | $R_2''$ |
|---|---|---|---|---|
| C-1 | 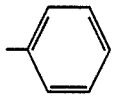 | —Cl | $-C_{12}H_{25}(n)$ | 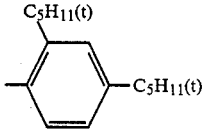 |
| C-2 | 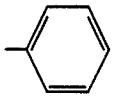 | —Cl | $-C_{12}H_{25}(n)$ | 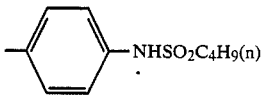 |
| C-3 | 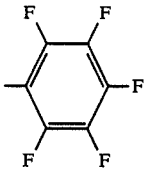 | —Cl | $-C_4H_9(n)$ | 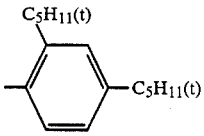 |
| C-4 | 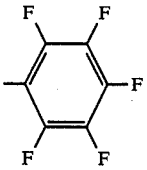 | $-OC_8H_{17}$ | $-C_{12}H_{25}(n)$ | 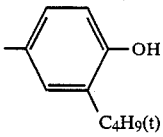 |
| C-5 | 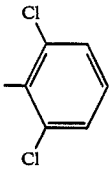 | 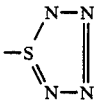 | $-C_{12}H_{25}(n)$ | 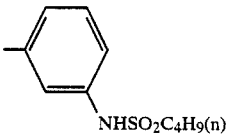 |
| C-6 | 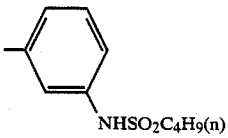 | —Cl | $-C_4H_9(n)$ | 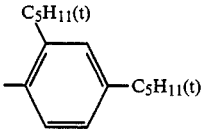 |
| C-7 | 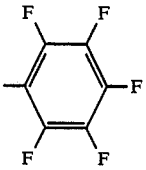 | —Cl | $-C_{12}H_{25}(n)$ | 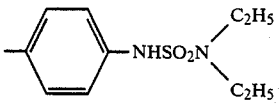 |
| C-8 | 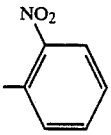 | 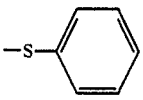 | $-C_4H_9(n)$ | 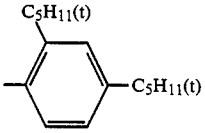 |

-continued
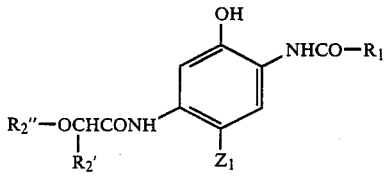
| Exemplified Cyan coupler No. | $R_1$ | $Z_1$ | $R_2'$ | $R_2''$ |
|---|---|---|---|---|
| C-9 | 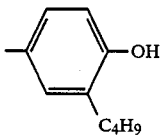 | —Cl | —$C_4H_9$(n) | 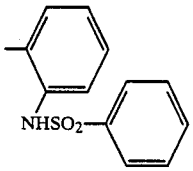 |
| C-10 | 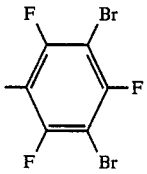 | —Cl | —$C_4H_9$(n) | 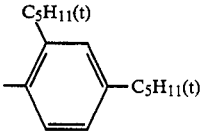 |
| C-11 | 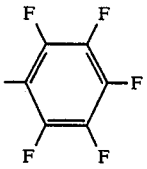 | —H | —$C_4H_9$(n) | 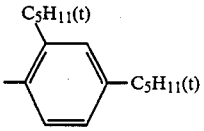 |
| C-12 | 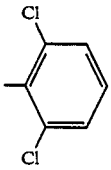 | —Cl | —$C_{12}H_{25}$(n) | 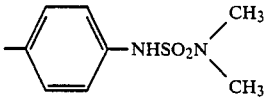 |
| C-13 | 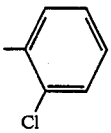 | —Cl | —$C_6H_{13}$(n) | 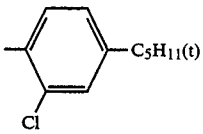 |
| C-14 | 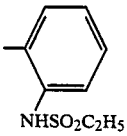 | —Cl | —$C_2H_5$ | 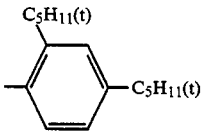 |
| C-15 | 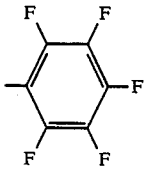 | —Cl | —$CH(CH_3)_2$ | 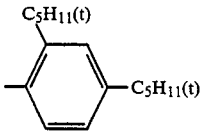 |

-continued

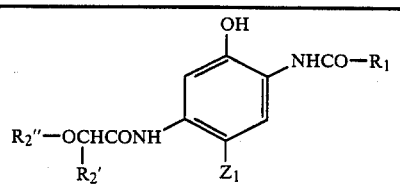

| Exemplified Cyan coupler No. | $R_1$ | $Z_1$ | $R_2'$ | $R_2''$ |
|---|---|---|---|---|
| C-16 | 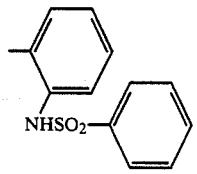 | —Cl | $-C_{10}H_{21}(n)$ | 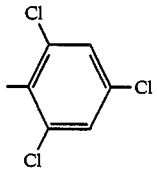 |

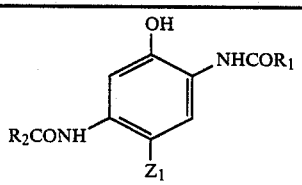

| Exemplified Cyan Coupler No. | $R_1$ | $Z_1$ | $R_2$ |
|---|---|---|---|
| C-17 | 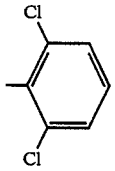 | —Cl | 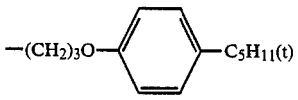 |
| C-18 | $-C(CH_3)_3$ | —Cl | 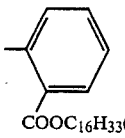 |
| C-19 | 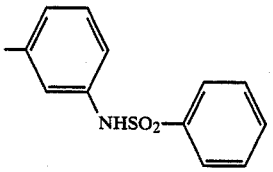 | —H | $-CH(SO_2C_{12}H_{25}(n))-C_{12}H_{25}(n)$ |

Next, the cyan couplers represented by the aforegiven formula [C-2] will be explained.

In Formula [C-2], the ballast groups represented by $R_5$ are organic groups each having both of a size and a shape capable of endowing couplers with an adequate volume so as to be substantially disable the couplers from dispersing into multilayers from the layers applied with the couplers.

The preferable ballst groups are those represented by the following formula:

$$-\underset{\underset{R_5'}{|}}{CH}-O-Ar$$

wherein $R'_5$ is an alkyl group having 1 to 12 carbon atoms; and Ar is such an aryl group as a phenyl group or the like, provided that the aryl groups may have a substituent.

The alkyl groups represented by $R_4$ may be those straight-chained or branched and, preferably, those having not less than two carbon atoms.

The typical examples of the groups, which are represented by $Z_2$ and are capable of being split off upon reaction with the oxidized products of a color developing agent, are the same as the typical examples of $Z_1$ denoted in the aforegiven formula [C-1].

Further, the typical examples of the cyan couplers represented by Formula [C-2] [hereinafter called Cyan coupler (2)] will be given below. It is, however, to be understood that the cyan couplers shall not be limited thereto.

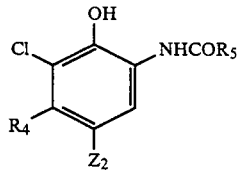

| Coupler No. | $R_4$ | $Z_2$ | $R_5$ |
|---|---|---|---|
| C-20 | $-C_2H_5$ | $-Cl$ | 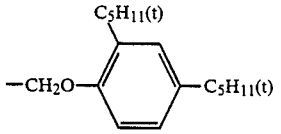 |
| C-21 | $-C_2H_5$ | 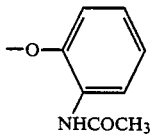 | 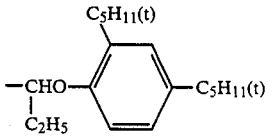 |
| C-22 | 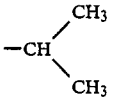 | $-Cl$ | 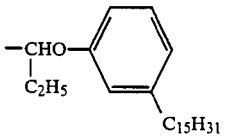 |
| C-23 | $-C_2H_5$ | $-Cl$ | 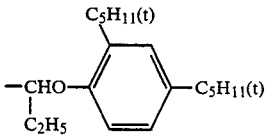 |
| C-24 | $-C_4H_9$ | $-F$ | 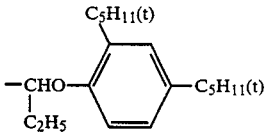 |
| C-25 | $-C_2H_5$ | $-F$ | 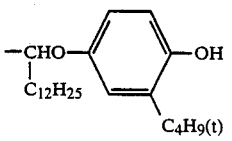 |
| C-26 | $-C_2H_5$ | $-Cl$ | 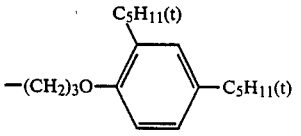 |
| C-27 | $-C_2H_5$ | $-Cl$ | 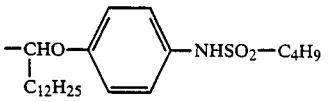 |

-continued
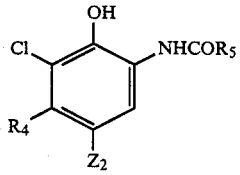
| Coupler No. | $R_4$ | $Z_2$ | $R_5$ |
|---|---|---|---|
| C-28 | $-C_2H_5$ | $-Cl$ | 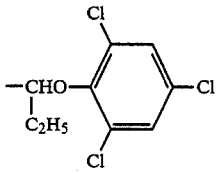 |
| C-29 | $-CH(CH_3)_2$ | $-Cl$ | $-C_{18}H_{37}$ |
| C-30 | $-C_3H_7$ | $-Cl$ | 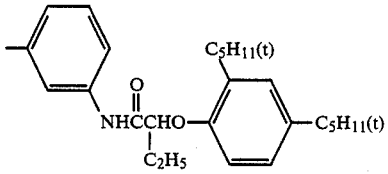 |
| C-31 | $-C_2H_4NHC(=O)CH_3$ | $-Cl$ | 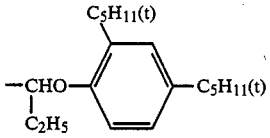 |
| C-32 | $-C_3H_5OCH_3$ | $-Cl$ | 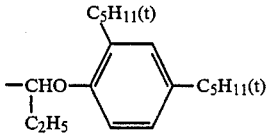 |
| C-33 | $-C_2H_5$ | $-Cl$ | 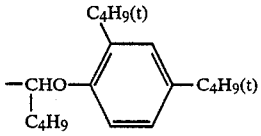 |
| C-34 | $-C_4H_9$ | $-OCH_2CH_2-SO_2CH_3$ | 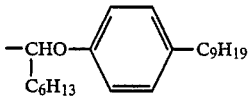 |
| C-35 | $-C_2H_5$ | $-Cl$ | 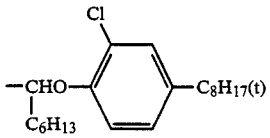 |
| C-36 | $-C_2H_5$ | $-Cl$ | 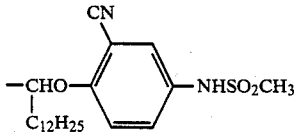 |
| C-37 | $-CH_3$ | $-Cl$ | 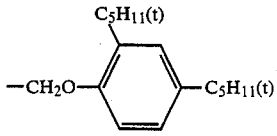 |

-continued

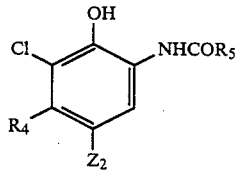

| Coupler No. | $R_4$ | $Z_2$ | $R_5$ |
|---|---|---|---|
| C-38 | $-CH_3$ | $-Cl$ | 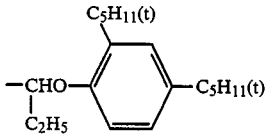 |
| C-39 | $-CH_3$ | $-Cl$ | 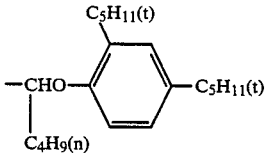 |

The above-mentioned cyan couplers (1) of the invention are described in Japanese Patent O.P.I. Publication Nos. 31935-1984, 121332-1984, 124341-1984, 139352-1984, 100440-1984, 166956-1984, 146050-1984, 112038-1975, 109630-1978 and 163537-1980; U.S. Pat. No. 2,895,826; and so forth.

The above-mentioned cyan couplers (2) of the invention are described in U.S. Pat. No. 3,772,002; Japanese Patent O.P.I. Publication Nos. 117249-1985, 205447-1985, 3142-1986, 9652-1986, 9653-1986, 27540-1986, 39045-1986, 50136-1986 and 105545-1986; and so forth.

In the invention, cyan couplers (1) and (2) each of the invention are jointly used. The cyan couplers (1) and (2) of the invention may usually be used in an aggregate amount of from $1\times10^{-3}$ mol to 1 mol and, preferably, from $1\times10^{-2}$ mol to $8\times10^{-1}$ mol, per mol of silver halide used.

The cyan couplers (1) and (2) of the invention may be used in any proportion of one to the other and, preferably, at a mol% of from 2:8 to 8:2.

Next, the above-mentioned non-color forming compounds represented by the aforegiven formula [I] (hereinafter called the non-color forming compound of the invention) will be explained below.

In Formula [I], the alkyl groups represented by $R_6$, $R_7$ and $R_8$ are preferably those having 1 to 32 carbon atoms. These alkyl groups may be straight-chained or branched and are also allowed to have a substituent. The aryl groups represented by $R_6$, $R_7$ and $R_8$ are preferably a phenyl group. These aryl groups are also allowed to have a substituent.

The heterocyclic groups represented by $R_6$, $R_7$ and $R_8$ are preferably a 5- to 7-membered one and may also be condensed. These groups are also allowed to have a substituent.

The rings completed by coupling $R_8$ to either one of $R_6$ and $R_7$ include, for example,

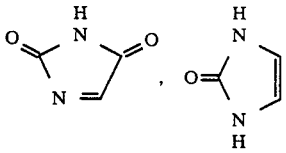

and so forh. These rings also include those having a substituent.

J represents an $-SO_2-$ group, an $-SO-$ group, a $-COO-$ group, a $-CO-$ group, a $-CS-$ group, an $$-\underset{\underset{R_9}{|}}{SO_2N}-$$

group or a $$-\underset{\underset{R_9}{|}}{CON}-$$

group, in which $R_9$ is a hydrogen atom, an alkyl group, an aryl group or a heterocyclic group.

The alkyl groups represented by $R_9$ are preferably those having 1 to 3 carbon atoms.

The aryl groups represented by $R_9$ are preferably a phenyl group which is allowed to have a substituent.

The heterocyclic groups represented by $R_9$ include, for example, a furyl group, a pyridyl group, a piperidyl group and so forth, which are also allowed to have a substituent.

J is preferably an $-SO_2-$ group or an $$-\underset{\underset{R_9}{|}}{SO_2N}-$$

group. In an

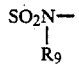
group, R9 preferably represents a hydrogen atom and an alkyl group.
The typical examples of the non-color forming compounds of the invention will be given below.
RA—NHSO$_2$—RB
| Coupler No. | RA | RB | Coupler No. | RA | RB |
|---|---|---|---|---|---|
| A-1 | 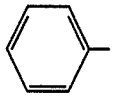 | 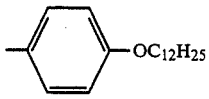 | A-11 | 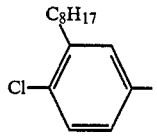 | 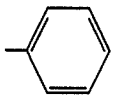 |
| A-2 | 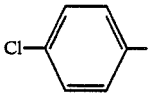 | 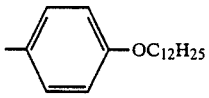 | A-12 | 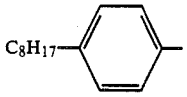 | 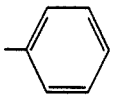 |
| A-3 | 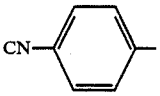 | 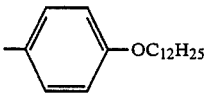 | A-13 | 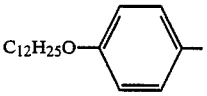 | 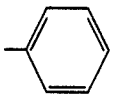 |
| A-4 | 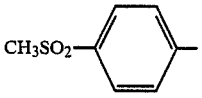 | 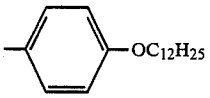 | A-14 | 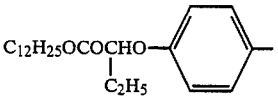 | 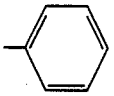 |
| A-5 | 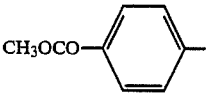 | 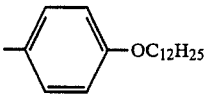 | A-15 | 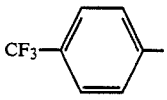 | 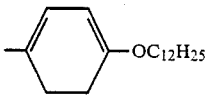 |
| A-6 | 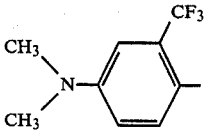 | 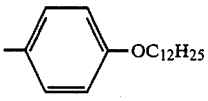 | A-16 | 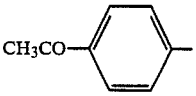 | 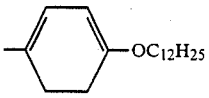 |
| A-7 | 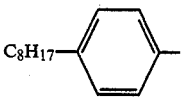 | 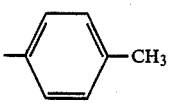 | A-17 | 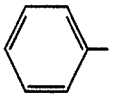 | —$C_{16}H_{33}$ |
| A-8 | 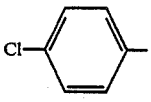 | 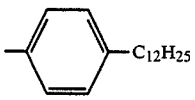 | A-18 | 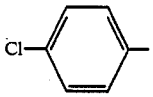 | —$C_{16}H_{33}$ |
| A-9 | 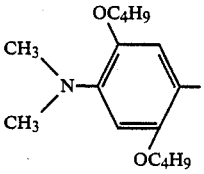 | 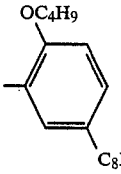 | A-19 | 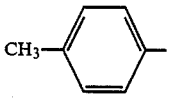 | —$C_{16}H_{33}$ |
| A-10 | 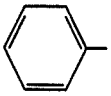 | 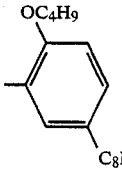 | A-20 | 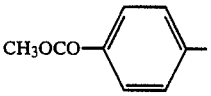 | —$C_{16}H_{33}$ |

-continued
| | | | | | |
|---|---|---|---|---|---|
| A-21 | 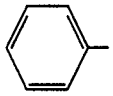 | 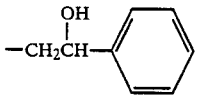 | A-30 | $CF_3CH{=}CH-$ | 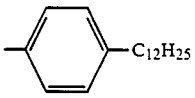 |
| A-22 | $Cl(CH_2)_2-$ | 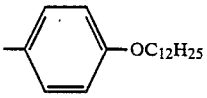 | A-31 | 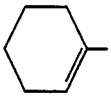 | 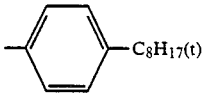 |
| A-23 | $CF_3CH_2-$ | 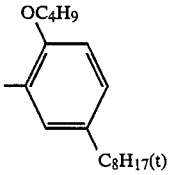 | A-32 | $HOCH_2CH_2C{\equiv}C-$ | 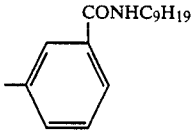 |
| A-24 | $C_{12}H_{25}-$ | 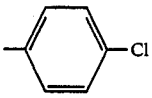 | A-33 | 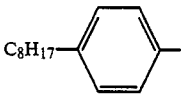 | $-OC_2H_5$ |
| A-25 | 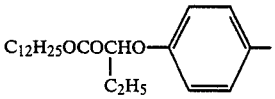 | 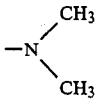 | A-34 | 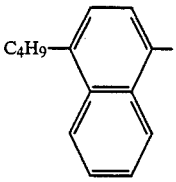 | 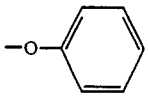 |
| A-26 | 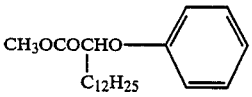 | 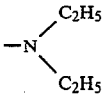 | A-35 | 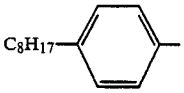 | 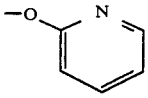 |
| A-27 | 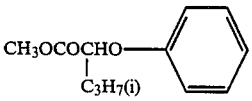 | 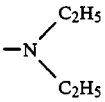 | A-36 | 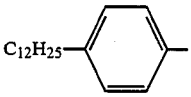 | 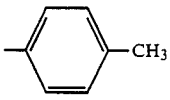 |
| A-28 | $H-$ | 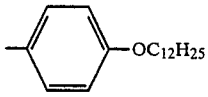 | A-37 | 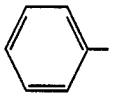 | 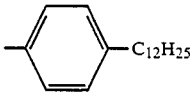 |
| A-29 | 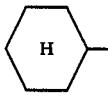 | 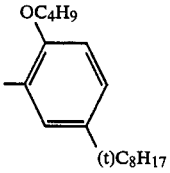 | A-38 | 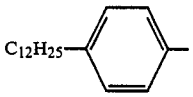 | 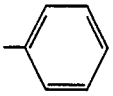 |
RA—NHCO—RB
| Coupler No. | RA | RB |
|---|---|---|
| A-39 | 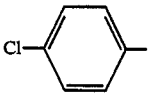 | 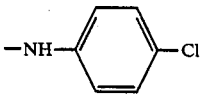 |
| A-40 | 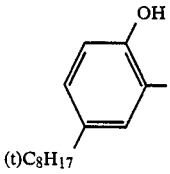 | 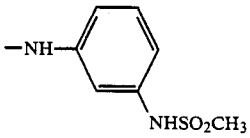 |

-continued
A-41
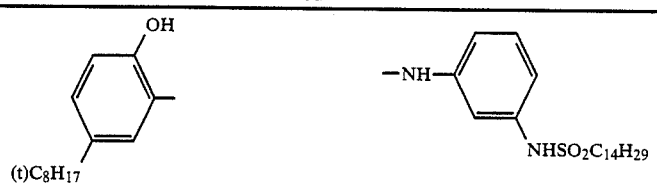
A-42
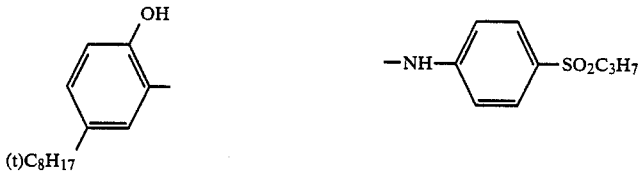
A-43
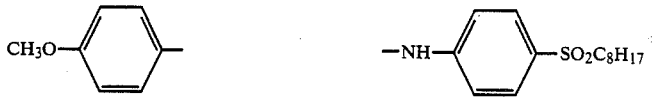
A-44
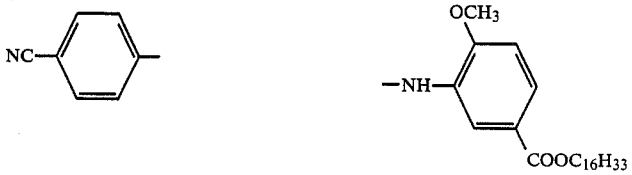
A-45
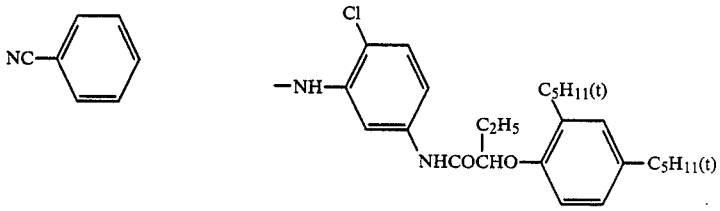
A-46
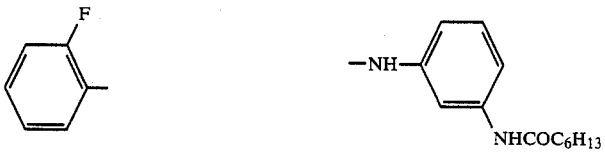
A-47
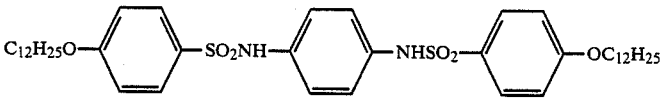
A-48
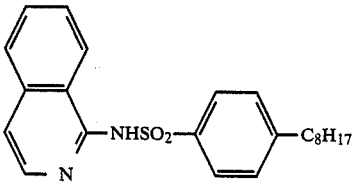
A-49
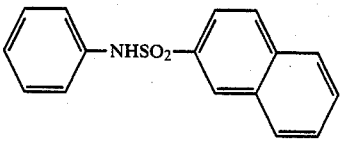
A-50
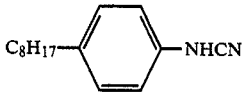

-continued

A-51

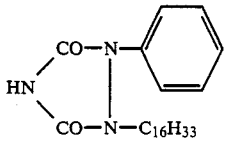

A-52

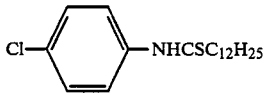

A-53

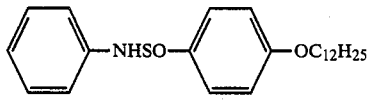

A-54

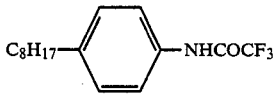

A-55

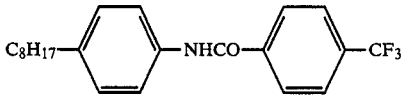

A-56

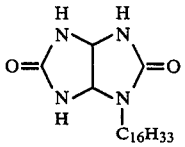

A-57

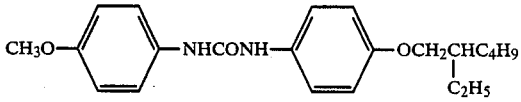

The non-color forming compounds of the invention may be synthesized in the conventional methods such as that described in, for example, Japanese Patent O.P.I. Publication No. 178258-1987.

The non-color forming compounds of the invention is used in an amount of, preferably, from 5 to 500 mol% and, more preferably, from 10 to 300 mol%, to the cyan couplers of the invention used.

Next, the compounds represented by the aforegiven formula [IIa] will be explained.

The alkyl groups represented by $R_{10}$ and $R_{11}$ include, preferably, those having 1 to 12 carbon atoms and, more preferably, those having 3 to 8 carbon atoms and branched in $\alpha$ position.

The particularly preferable groups represented by $R_{10}$ and $R_{11}$ are a t-butyl group or a t-pentyl group.

The alkyl groups repesented by $R_{12}$ may be straight-chained or branched. These groups include, for example, a methyl group, an ethyl group, a propyl group, a butyl group, an actyl group, an octadecyl group and so forth. When these alkyl groups have a substituent, such substituents include, for example, a halogen atom, a hydroxyl group, a nitro group, a cyano group, an aryl group, an amino group, an alkoxycarbonyl group, an aryloxycarbonyl group, a carbamoyl group, a heterocyclic group and so forth.

The monovalent organic groups represented by $R'_{12}$ and $R''_{12}$ include, for example, an alkyl group, an aryl group, a cycloalkyl group, a heterocyclic group and so forth. When these organic groups have a substituent, such substituents include, for example, a halogen atom, a hydroxyl group, a nitro group, a cyano group, an amino group, an alkyl group, an aryl group, an alkenyl group, an acyloxy group and so forth.

The compounds represented by Formula [II-1] in the invention are preferably the compounds represented by the following formula [IIa']:

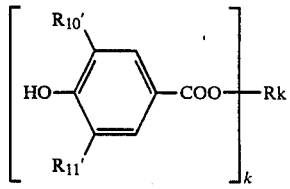

wherein $R'_{10}$ and $R'_{11}$ are a straight-chained or branched alkyl group having 3 to 8 carbon atoms and, particularly, a t-butyl group, a t-pentyl group and so forth are preferable; and Rk is a k-valent organic group and k is an integer of from 1 to 6.

The k-valent organic groups represented by Rk include, for example, an alkyl group, an alkenyl group, a polyvalent unsaturated hydrocarbon group such as an ethylene group, a trimethylene group, a propylene group, a hexamethylene group, a 2-chlorotrimethylene group and so forth, an unsaturated hydrocarbon group such as a glyceryl group, a diglyceryl group, a pentaerythrityl, dipentaerythrityl and so forth, an alicyclic hydro-carbon group such as a cyclopropyl group, a cyclohexyl group, a cyclohexenyl group and so forth, an aryl group such as a phenyl group and so forth, an arylene group such as a 1,2-, 1,3- or 1,4-phenylene group, a 3,5-dimethyl-1,4-phenylene group, a 2-t-butyl-1,4-phenylene group, a 2-chloro-1,4-phenylene group, a napthalene group and so forth, a 1,3,5-3rd position substituted benzene group, and so forth.

Besides the above-given groups, Rk include a k-valent organic groups bonded to any one of the above-given groups through an —O— group, an —S— group or an —$SO_2$— group.

The further preferable Rk include, for example, a 2,4-di-t-butylphenyl group, a 2,4-di-t-pentylphenyl group, a p-dodecylphenyl group, a 3,5-di-t-butyl-4-hydroxyphenyl group, and a 3,5-di-t-pentyl-4-hydroxyphenyl group.

The preferable k is an integer of from 1 to 4.

The typical examples of the compounds represented by Formula [IIa] will be given below. It is, however, to be understood that the compounds shall not be limited thereto.

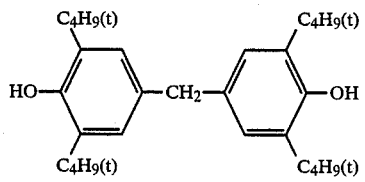
IIa-1

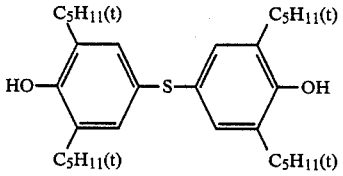
IIa-2

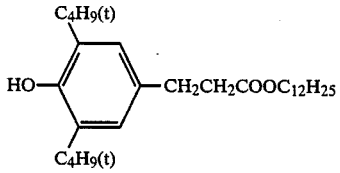
IIa-3

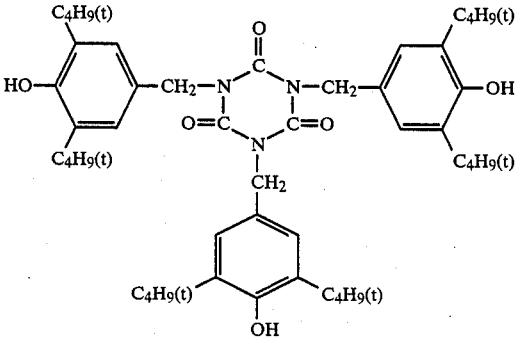
IIa-4

-continued

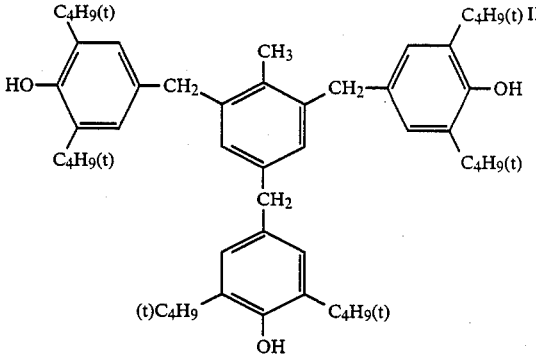
IIa-5

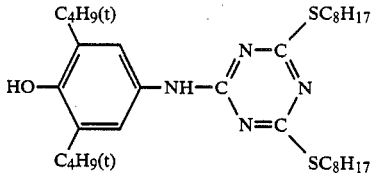
IIa-6

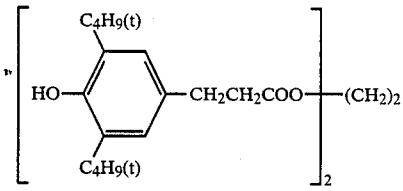
IIa-7

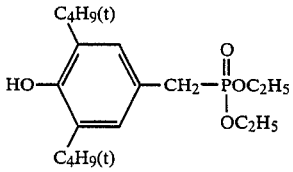
IIa-8

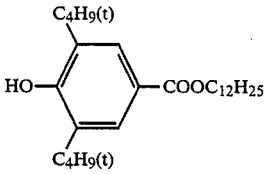
IIa-9

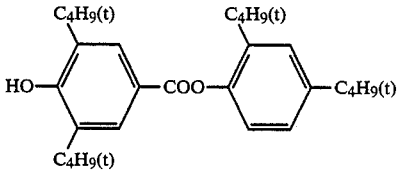
IIa-10

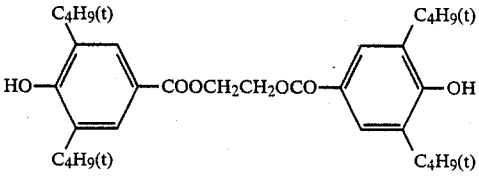
IIa-11

-continued

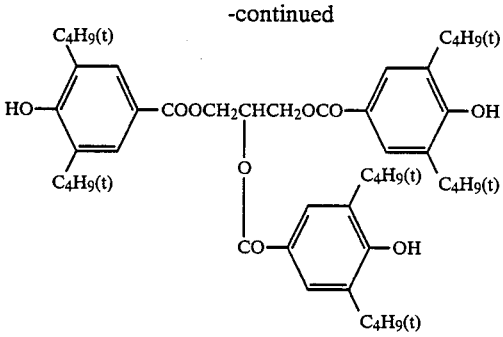

IIa-12

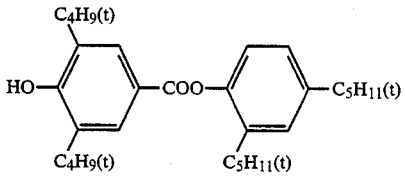

IIa-13

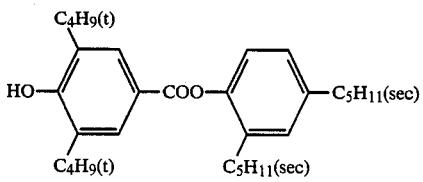

IIa-14

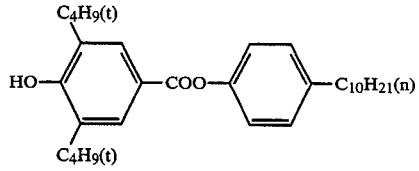

IIa-15

Now, the compounds represented by the aforegiven formula [IIb] will be explained.

The preferable alkyl groups represented by $R_{13}$ are those having 1 to 12 carbon atoms, and the preferable alkenyl and alkinyl groups represented thereby are those having 2 to 4 carbon atoms. The preferable groups represented by $R_{13}$ include a hydrogen atom, an alkyl group, an alkenyl group, an alkinyl group and a —COR''$_{13}$ group. The monovalent organic groups represented by R''$_{13}$ include, for example, an alkyl group, an alkenyl group, an alkinyl group, an aryl group and so forth.

The preferable alkyl groups represented by $R_{14}$, R'$_{14}$ and R''$_{14}$ are straight-chained or branched alkyl groups having 1 to 5 carbon atoms, and the particularly preferable one is a methyl group.

In $R_{15}$ and $R_{16}$, the monovalent organic groups represented by R''' include, for example, an alkyl group, an alkenyl group, an alkinyl group, an aryl group, an alkylamino group, an arylamino group and so forth. The heterocyclic rings completed by bonding $R_{15}$ to $R_{16}$ to each other include, for example,

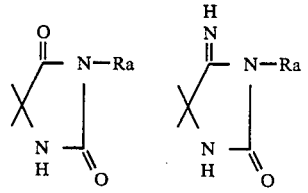

wherein Ra is a hydrogen atom, an alkyl group, a cycloalkyl group or a phenyl group.

In the invention, the preferable compounds represented by Formula [IIb] are those represented by the following formula [IIb']:

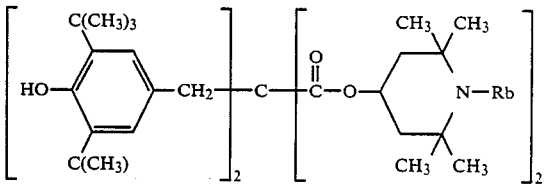

wherein Rb is an alkyl group, an alkenyl group, an alkinyl group or an acyl group.

The further preferable groups represented by Rb include, for example, a methyl group, an ethyl group, a vinyl group, an allyl group, a propynyl group, a benzyl group, an acetyl group, a propionyl group, an acryloyl group, a methacryloyl group and a crotonoyl group.

The typical examples of the compounds represented by Formula [IIb] will be given below. It is, however, to be understood that the compounds shall not be limited thereto.

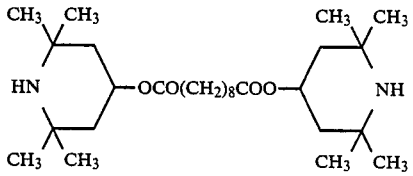

IIb-1

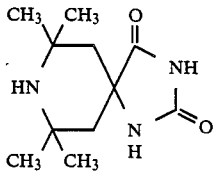

IIb-2

-continued
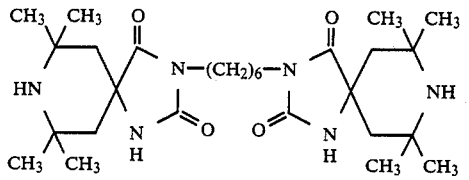
IIb-3
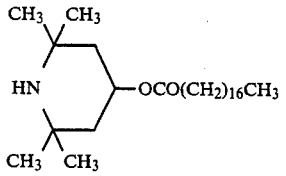
IIb-4
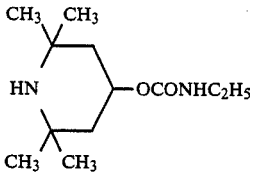
IIb-5
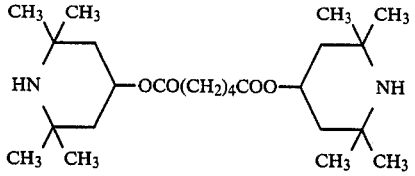
IIb-6
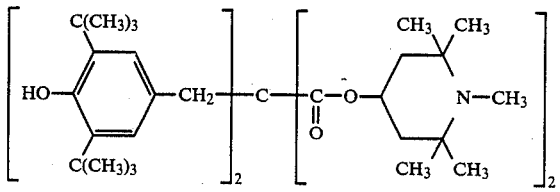
IIb-7
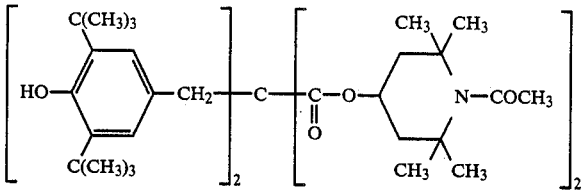
IIb-8
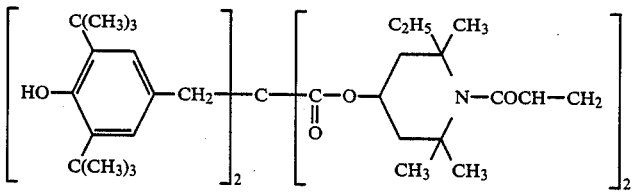
IIb-9
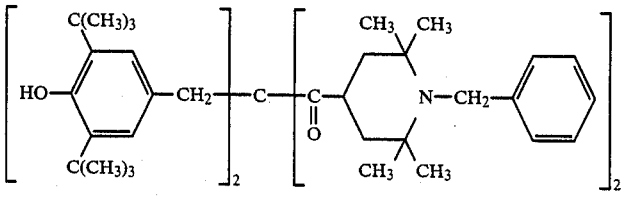
IIb-10

-continued

IIb-11

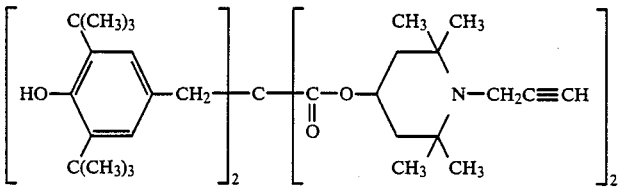

IIb-12

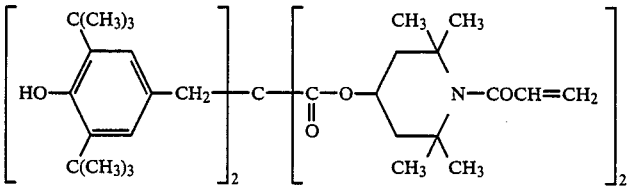

The compounds represented by the aforegiven formula [IIc] will now be explained.

The particularly preferable halogen atom represented by $R_{17}$, $R_{18}$ and $R_{19}$ is a chlorine atom.

The preferable alkyl and alkoxy groups represented by $R_{17}$, $R_{18}$ and $R_{19}$ are those having 1 to 20 carbon atoms. The preferable alkenyl groups represented thereby are those having 1 to 20 carbon atoms and they may be straight-chained or branched.

The above-mentioned alkyl, alkenyl and alkoxy groups include those having a substituent. Such substituents include, for example, an aryl group, a cyano group, a halogen atom, a heterocyclic group, a cycloalkyl group, a cycloalkenyl group, a spiro-compound residual group, a bridge-linked hydrocarbon compound residual group, an acyl group, a carboxy group, a carbamoyl group, an alkoxycarbonyl group, an aryloxycarbonyl group, a hydroxy group, an alkoxy group, an aryloxy group, a heterocyclic oxy group, a siloxy group, an acyloxy group, a carbamoyloxy group, a nitro group, an amino group (including a substituted amino group), a sulfamoylamino group, an alkoxycarbonylamino group, an aryloxycarbonylamino group, an acylamino group, a sulfonamido group, an imido group, a ureido group, an alkylthio group, an arylthio group, a heterocyclic thio group, a sulfonyl group, a sulfinyl group, a sulfamoyl group, a phosphonyl group and so forth.

The preferable aryl groups represented by $R_{17}$, $R_{18}$ and Rhd 19 include, for example, a phenyl group. The preferable aryloxy groups represented thereby include, for example, a phenyloxy group. These groups are also allowed to have a substituent (such as an alkyl group, an alkoxy group and so forth).

Among the groups represented by $R_{18}$ and $R_{19}$, the preferable groups are a hydrogen atom, an alkyl group, an alkoxy group and an aryl group, and the more preferable groups are a hydrogen atom, an alkyl group and an alkoxy group.

Among the groups represented by $R_{17}$, the particularly preferable groups are a hydrogen atom, a halogen atom, an alkyl group and an alkoxy group.

The typical examples of the compounds represented by Formula [IIc] will be given below. It is, however, to be understood that the compounds shall not be limited thereto.

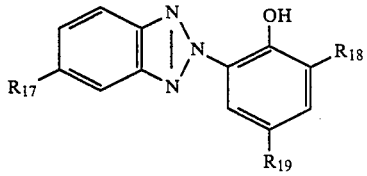

| Compound No. | $R_{17}$ | $R_{18}$ | $R_{19}$ |
|---|---|---|---|
| IIc-1 | —H | —H | —H |
| IIc-2 | —H | —H | —$CH_3$ |
| IIc-3 | —H | —H | —$C_4H_9$(t) |
| IIc-4 | —H | —$C_4H_9$(t) | —$C_4H_9$(t) |
| IIc-5 | —Cl | —$C_4H_9$(t) | —$CH_3$ |
| IIc-6 | —Cl | —$C_4H_9$(t) | —$C_4H_9$(t) |
| IIc-7 | —H | —$C_5H_{11}$(t) | —$C_5H_{11}$(t) |
| IIc-8 | —$C_4H_9$(t) | —$C_4H_9$(t) | —$C_4H_9$(t) |
| IIc-9 | —$C_4H_9$(t) | —$C_4H_9$(sec) | —$C_4H_9$(t) |
| IIc-10 | —$C_5H_{11}$(t) | —$C_5H_{11}$(t) | —$C_5H_{11}$(t) |
| IIc-11 | —H | —H | —$C_8H_{17}$(t) |
| IIc-12 | —H | —$C_4H_9$(t) | —$C_4H_9$(t) |
| IIc-13 | —H | —$CH_3$ | —$C_4H_9$(sec) |
| IIc-14 | —$OCH_3$ | —$C_5H_{11}$(t) | —$C_5H_{11}$(t) |
| IIc-15 | —$CH_3$ | —$C_5H_{11}$(t) | 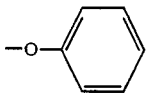 |
| IIc-16 | —H | —H | —$C_{12}H_{25}$(t) |
| IIc-17 | —$OCH_3$ | —H | —$OC_8H_{17}$(sec) |

In the invention, there uses at least one compound (hereinafter simply called Compound II of the invention) selected from the group consisting of the compounds represented by Formula [IIa], [IIb] or [IIc]. These Compound II of the invention may be used independently or in combination. The amount thereof to be added is, preferably, from 5 to 300 mol% and, more preferably, from 10 to 200 mol% to the cyan couplers used in the silver halide emulsion layers containing Compound II of the invention.

As for adding Cyan couplers (1) and (2) of the invention, the non-color forming compound of the invention and Compound II of the invention into a silver halide photographic light-sensitive material, there are available a variety of methods such as a solid dispersion method, a latex dispersion method, an oil drop-in-water type emulsification-dispersion method and so forth. Among these methods, for example, the oil drop-in-water type emulsification-dispersion method may be carried out in such a manner that the above-mentioned couplers and compounds are usually dissolved in a high boiling solvent having a melting point of not lower than about 150° C. (such as a phthalic acid ester, a phosphoric acid ester and so forth) and, if required, with a low boiling point and/or water-soluble organic solvent in combination, and the resulting solution is so dispersed to be emulsified in such a hydrophilic binder as an aqueous gelatin solution by making use of a surface active agent and then the resulting dispersion is added into an objective hydrophilic colloidal layer. In particular, it is preferred that the above-mentioned couplers and compounds are contained in one and the same dispersion.

Cyan couplers (1) and (2), the non-color forming compound and Compound II each of the invention are contained in at least one of the same silver halide emulsion layers. Such layer also contains silver halide grains having a silver chloride content of not less than 90 mol% (hereinafter called the silver halide grains of the invention).

The silver halide grains of the invention have a silver chloride content of not less than 90 mol%, that is, preferably not less than 95 mol%. On the other hand, the silver bromide content thereof is preferably not more than 5 mol% and, more preferably, from 0.1 to 1 mol%. Further, the silver iodide content thereof is preferably not more than 0.5 mol%.

The silver halide grains of the invention may be used independently or in combination and they may also be used in the form of the mixture with other silver halide grains having a different composition. Further, they may be used in the form of the mixture with silver halide grains having a silver chloride content of less than 10 mol%.

In a silver halide emulsion layer containing the silver halide grains of the invention, a proportion of the silver halide grains of the inention to an aggregate amount of the whole silver halide grains contained in the above-mentioned emulsion layer is to be not less than 60% by weight and, preferably, not less than 80% by weight.

The composition of the silver halide grains of the invention may be either uniform from the inside to the outside thereof or different from each other side thereof. In the latter case, the composition may be varied either continuously or intermittently.

There is no particular limitation to the grain sizes of the silver halide grains of the invention. However, taking other photographic characteristics such as a rapid processability, sensitivity and so forth into consideration, the grain size thereof is within the range of, preferably, from 0.2 to 1.6 μm and, more preferably, from 0.25 to 1.2 μm. The above-mentioned grain sizes may be measured in a variety of methods commonly used in the field of the art. Typical methods are described in, for example, R. P. Loveland, 'Particle-Size Measurement', A.S.T.M. Symposium on Light Microscopy, 1955, pp. 94–122; or C. E. K. Mees and T. H. James, 'The Theory of the Photographic Process', 3rd Ed., The Macmillan Co., 1966, Chap. 2.

The grain sizes can be measured by making use of the projective area of a grain or an approximate grain diameter. When the grains are substantially uniform in configuration, a substantially accurate grain size distribution may be expressed in terms of diameter or projective area.

The grain size distribution of the silver halide grains of the invention may be either of the polydisperse type or of the monodisperse type. In the grain size distribution of silver halide grains, the variation coefficient thereof is, preferably, not more than 0.22 and, more preferably, not more than 0.15 in monodisperse type silver halide grains. Herein, a variation coefficient means a coefficient indicating a broadness of a grain size distribution, which may be obtained by the following equations:

$$\text{Variation coefficient } (S/\bar{r}) = \frac{\text{Standard deviation of grain size distribution}}{\text{Average grain size}}$$

$$\text{Standard deviation of grain size distribution } (S) = \sqrt{\frac{\Sigma(\bar{r} - ri)^2 ni}{\Sigma ni}}$$

$$\text{Average grain size } (\bar{r}) = \frac{\Sigma niri}{\Sigma ni}$$

wherein ri is a grain size of individual grains and ni is the numbers thereof.

A grain size mentioned herein means the diameter of a grain in the case of a globular-shaped silver halide grain, and the diameter of a circular image having the same area as that of the projective image of a grain in the case of a grain in cubic shape or other shapes than the globular shape.

There may be used any shaped silver halide grains of the invention. One of the preferable examples thereof is a cubic crystal having a {100} plane as the crystal planes thereof.

There may also be used the grains each having a crystal configuration in an octahedron, a tetradecahedron, a dodecahedron and so forth, which are prepared in the methods described in, for example, U.S. Pat. Nos. 4,183,756 and 4,225,666; Japanese Patent O.P.I. Publication No. 26589-1980; Japanese Patent Examined Publication No. 42737-1980; The Journal of Photographic Science, 21, 39, 1973; and so forth.

In the course of forming silver halide grains used in the emulsions of the invention, and/or in the course of growing the grains, metal ions are added into the grains by making use of a salt of cadmium, zinc, lead or thallium, an iridium salt or the complex salts thereof, a rhodium salt or the complex salts thereof or an iron salt or the complex salts thereof, and the metal ions may be contained in the insides and/or the surfaces of the grains; and a reduction-sensitizing speck may be provided to the inside and/or outside of grains by putting them in a suitable reducible atmosphere.

The preferable silver halide grains used in the emulsions of the invention are those forming a latent image mainly on the surfaces thereof.

The emulsions of the invention may be chemically sensitized in such an ordinary method as a sulfur sensitizing method using a sulfur-containing compound capable of making reaction with silver ions; a selenium sensitizing method using a selenium compound; a reduction-sensitizing method using a reducing substance; a noble metal sensitizing method using gold or other noble metal compounds; and so forth. These methods may be applied independently or in combination.

In the invention there may be used a chemical sensitizer such as a chalcogen sensitizer. Among these sensitizers, a sulfur sensitizer and a selenium sensitizer are preferably used. Such sulfur sensitizers include, for example, a thiosulfate, an allylthiocarbazide, a thiourea, an allylisothiocyanate, a cystine, a p-toluenethiosulfonate, and a rhodanine. Besides the above, there may also be used other sulfur senstizers such as those described in, for example, U.S. Pat. Nos. 1,574,944, 2,410,689, 3,501,313 and 3,656,955; West German Patent (OLS) Publication No. 1,422,869; Japanese Patent O.P.I. Publication Nos. 24937-1981 and 45016-1980; and so forth. The amounts of the sulfur sensitizers added are varied in a considerably wide range according to various conditions such as a pH value, a temperature, a silver halide grain size and so forth. As a rough standard of such adding amounts is preferably of the order of from $10^{-7}$ mol to $10^{-1}$ mol per mol of a silver halide used.

As for the selenium sensitizers, there may be used an aliphatic isoselenocyanate such as an allylisoselenocyanate; a selenourea; a selenoketone; a selenoamide; a selenocarboxylate and the esters thereof; a selenophosphate; and a selenide such as diethyl selenide, diethyl diselenide; and so forth. The typical examples thereof are described in, for example, U.S. Pat. Nos. 1,574,944, 1,602,592 and 1,623,499.

In addition, a reduction-sensitization may be applied in combination. The reducing agents include, for example, stannous chloride, thiourea dioxide, hydrazine, polyamine and so forth.

Further a noble metal compound other than gold, such as a palladium compound and so forth, may also be used in combination.

It is preferred that the silver halide grains of the invention contain a gold compound. Such gold compounds preferably used in the invention may have an oxidation number of either+monovalency or+trivalency. Various kinds of gold compounds may be used for. The typical examples thereof include, for example, a chloroaurate, a potassium chloroaurate, an auric trichloride, a potassium auric thiocyanate, a potassium iodoaurate, a tetracyanoauric azide, an ammonium aurothiocyanate, a pyridyl trichlorogold, a gold sulfide, a gold selenide and so forth.

It is also allowed that gold compounds may be used so as either to sensitize silver halide grains or not substantially to contribute to sensitization.

An amount of such gold compounds added is varied according to the conditions. However, the rough standard thereof is from $10^{-8}$ mol to $10^{-1}$ mol and, preferably, from $10^{-7}$ to $10^{-2}$ mol per mol of a silver halide used. Such gold compounds may be added in any steps of forming, physical or chemical ripening or in the steps after completing the chemical ripening silver halide grains.

The emulsions of the invention may be spectrally sensitized to any desired wavelength range by making use of a spectral sensitizing dye. Such spectral sensitizing dyes may be used independently or in combination.

Such emulsions are also allowed to contain, together with the spectral sensitizing dyes, a supersensitizer for enhancing the sensitization function of a spectral sensitizing dye, that is, a dye not having any spectral sensitizing function in itself or a compound not substantially absoring any visible rays of light.

Silver halide grains, which may be used in emulsion layers other than the silver halide emulsion layers each containing the silver halide grains of the invention, shall not be particularly limitative, but they preferably include the silver halide grains of the invention.

The silver halide photographic light-sensitive materials of the invention each having the above-mentioned constitution may be taken in the forms of, for example, a color negative or positive film, a color print paper and so forth. In particular, when using them as a color print paper for direct appreciation use, the advantages of the invention can effectively be displayed.

The silver halide photographic light-sensitive materials including the above-mentioned color print papers may be of the monochromatic type or of the multicolor type. In the case of multicolor silver halide photographic light-sensitive materials, for the purpose of carrying out a subtractive color reproduction process, a each of them usually is comprised of a support having thereon suitable numbers of both suitably arranged non-light-sensitive layers and silver halide emulsion layers containing magenta, yellow and cyan couplers to serve as the photographic couplers. Such numbers and arrangements of the layers may also suitably be changed according to the desired characteristics and the purposes of use.

In the case that a silver halide photographic light-sensitive material used in the invention is a multicolor light-sensitive material, it is particularly preferred to arrange the layers, on a support in the order from the support, typically, a yellow dye image forming layer, an interlayer, a megenta dye image forming layer, an interlayer, a cyan dye image forming layer, an interlayer, and a protective layer.

In a multicolor light-sensitive material relating to the invention, preferably useful magenta couplers contained in a magenta dye image forming layer are pyrazoloazole type magenta couplers having at least one —$NHSO_2$— portion in the positions other than the coupling active site, which is represented by the following formula [M-1], (hereinafter called the magenta couplers of the invention):

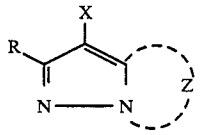

Formula [M-1]

wherein Z is a group of non-metal atoms necessary for completing a nitrogen-containing heterocyclic ring and the rings completed by the Z may have a substituent; X is a hydrogen atom or a group capable of being split off upon reaction with the oxidized products of a color developing agent; R is a hydrogen atom or a substituent, provided that R is a substituent and/or the ring completed by Z has a substituent, and at least one of the substituents has a —$NHSO_2$— portion.

In the above-given Formula [M-1], the substituents represented by R shall not be limitative, but include, for example, each group of alkyl, aryl, anilino, acylamino, sulfonamido, alkylthio, arylthio, alkenyl, cycloalkyl or the like; and, besides the above, they also include, for example, a halogen atom; each group of cycloalkenyl, alkinyl, heterocyclic, sulfonyl, sulfinyl, phosphonyl, acyl, carbamoyl, sulfamoyl, cyano, alkoxy, aryloxy, heterocyclic oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl or heterocyclicthio; a spiro compound residual group, a bridge-linked hydrocarbon compound residual group and so forth.

The alkyl groups represented by R include preferably those having 1 to 32 carbon atoms and they may be straight-chained or branched. The aryl groups represented by R include, preferably, a phenyl group.

The acylamino groups represented by R include, for example, an alkylcarbonylamino group, an arylcarbonylamino group and so forth.

The sulfonamido groups represented by R include, for example, an alkylsulfonylamino group, an aryl sulfonylamino group and so forth.

The alkyl component of the alkylthio group and the aryl component of the arylthio group each represented by R include, for example, the alkyl groups and the aryl groups each represented by the above-given R.

The alkenyl groups represented by R include, preferably, those having 2 to 32 carbon atoms, and the cycloalkyl groups include those having, preferably, 3 to 12 carbon atoms and, more preferably, 5 to 7 carbon atoms. Such alkenyl groups may be straight-chained or branched.

The cycloalkenyl groups represented by R include those having, preferably, 3 to 12 carbon atoms and, more preferably, 5 to 7 carbon atoms.

The sulfonyl groups represented by R include, for example, an alkylsulfonyl group, an arylsulfonyl group and so forth.

The sulfinyl groups represented thereby include, for example, an alkylsulfinyl, an arylsulfinyl group and so forth.

The phosphonyl groups represented thereby include, for example, an alkylphosphonyl group, an alkoxyphosphonyl group, an aryloxyphosphonyl group, an arylphosphonyl group and so forth.

The acyl groups represented thereby include, for example, an alkylcarbonyl group, an arylcarbonyl group and so forth.

The carbamoyl groups represented thereby include, for example, an alkylcarbamoyl group, an arylcarbamoyl group and so forth.

The sulfamoyl groups represented thereby include, for example, an alkylsulfamoyl group, an arylsulfamoyl group and so forth.

The acyloxy groups represented thereby include, for example, an alkylcarbonyloxy group, an arylcarbonyloxy group and so forth.

The carbamoyloxy groups represented thereby include, for example, an alkylcarbamoyloxy group, an arylcarbamoyloxy group and so forth.

The ureido groups represented thereby include, for example, an alkylureido group, an arylureido group and so forth.

The sulfamoylamino groups represented thereby include, for example, an alkylsulfamoylamino group, an arylsulfamoylamino group and so forth.

The heterocyclic groups represented thereby include, preferably, those having 5 to 7 membered ring and, more typically, a 2-furyl group, a 2-thienyl group, a 2-pyrimidinyl group, a 2-benzothiazolyl group and so forth.

The preferable heterocyclic oxy groups represented thereby are those having a 5 to 7 membered ring, including, for example, a 3,4,5,6-tetrahydropyranyl-2-oxy group, a 1-phenyltetrazole-5-oxy group and so forth.

The preferable heterocyclic thio groups represented thereby are those having a 5 to 7 membered ring, such as a 2-pyridylthio group, a 2-benzothiazolylthio group, a 2,4-diphenoxy-1,3,5-triazole-6-thio group and so forth.

The siloxy groups represented thereby include, for example, a trimethylsiloxy group, a triethylsiloxy group, a dimethylbutylsiloxy group and so forth.

The imido groups represented thereby include, for example, a succinimido group a 3-heptadecyl succinimido group, a phthalimido group, a glutarimido group and so forth.

The spiro compound residual groups represented thereby include, for example, a spiro[3,3]heptane-1-yl group and so forth.

The bridge-linked hydrocarbon compound residual group include, for example, a bicyclo[2,2,1]heptane-1-yl group, a tricyclo [3,3,1,1$^{3'7}$]decane-1-yl group, a 7,7-dimethylbicyclo[2,2,1]heptane-1-yl group and so forth.

The groups capable of being split off upon reaction with the oxidized product of a color developing agent represented by X include, for example, a halogen atom (such as a chlorine atom, a bromine atom, a fluorine atom and so forth), an alkoxy group, an aryloxy group, a heterocyclic oxy group, an acyloxy group, a sulfonyloxy group, an alkoxycarbonyloxy group, an aryloxycarbonyl group, an alkyloxalyloxy group, an alkoxyoxalyloxy group, an alkylthio group, an arylthio group, a heterocyclic thio group, analkyloxythiocarbonylthio group, an acylamino group, a sulfonamido group, a nitrogen-containing heterocyclic group bonded to an N atom, an alkyloxycarbonylamino group, an aryloxycarbonylamino group, a carboxyl group, and a group represented by the following formula:

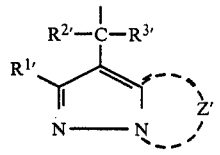

wherein $R^{1'}$ is synonymous with the above-denoted R, Z' is synonymous with the above-denoted Z, and $R^{2'}$ and $R^{3'}$ are each a hydrogen atom, an aryl group, an alkyl group or a heterocyclic group.

Among them, a halogen atom is preferable and a chlorine atom is particularly preferable.

The nitrogen-containing heterocyclic rings completed by Z or Z' include, for example, a pyrazole ring, an imidazole ring, a triazole ring, a terazole ring or the like.

The substituents which the above-given rings are allowed to have include, for example, those given to the above denoted R.

Those represented by the formula [M-1] may more typically be represented by the following formulas [M-II] through [M-VII], respectively:

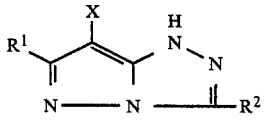

Formula [M-II]

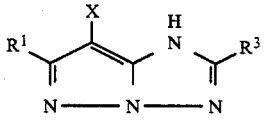

Formula [M-III]

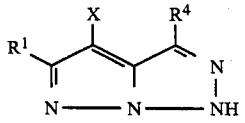

Formula[M-IV]

-continued

Formula [M-V]

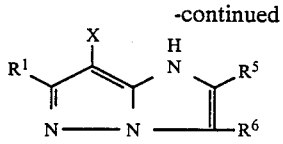

Formula [M-VI]

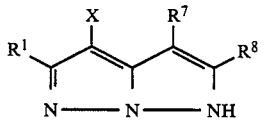

Formula [M-VIII]

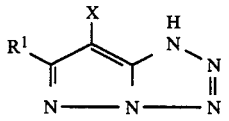

In the above-given formulas [M-II] through [M-VII], $R^1$ through $R^8$ and X are synonymous with R and X, respectivvely.

Among those represented by Formula [M-1], the preferable ones are represented by the following formula [M-VIII]:

Formula [M-VIII]

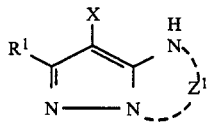

wherein $R^1$, X and $Z^1$ are synonymous with R, X and Z denoted in Formula [M-1].

Among the magenta couplers represented by the formulas [M-II] through [M-VII], the particularly preferably ones are represented by Formula [M-II].

For the substituents represented by R and $R^1$ on the above-given hetercyclic rings, the most preferable ones are represented by the following formula [M-IX]:

Formula [M-IX]

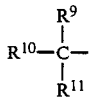

wherein $R^9$, $R^{10}$ and $R^{11}$ are synonymous with the aforegiven R, respectively.

Any two out of the above-given $R^9$, $R^{10}$ and $R^{11}$, for example, $R^9$ and $R^{10}$, are allowed to complete a saturated or unsaturated ring such as a cycloalkane, cycloalkene or heterocyclic ring upon coupling to each other. It is also allowed to constitute a cross-linked hydrocarbon compound residual group upon coupling the ring to $R^{11}$.

The preferable cases of Formula [M-IX] are (i) the case that at least two of $R^9$ through $R^{11}$ are alkyl groups, and (ii) the case that one of $R^9$ through $R^{11}$, that is $R^{11}$ for example, is a hydrogen atom, and the other two, i.e., $R^9$ and $R^{10}$, complete a cycloalkyl together with a root carbon atom upon coupling the two each other.

Among the case (i), the prefrable instance is that two of $R^9$ through $R^{11}$ are alkyl groups and the rest is a hydrogen atom or an alkyl group.

The magenta couplers of the invention have at least one —$NHSO_2$— portion in a position other than the coupling active site. It is preferred that this —$NHSO_2$— portion is contained in a substituent represented by R denoted in Formula [M-1] and/or a substituent belonging to a ring completed by Z, as a part of the substituent.

To be more concrete, in the aforegiven formulas [M-ii] through [M-VII], the above-mentioned —$NHSO_2$— portion is contained in the substituent represented by $R^1$ through $R^8$. In this case, it is preferred that the —$NHSO_2$— portion is coupled to a mother nucleus through such a divalent crosslinking group as an alkylene group, an arylene group or the like.

The partucularly preferable substituents each containing the above-mentioned —$NHSO_2$— portion are presented by the following formula [A]:

Formula [A]

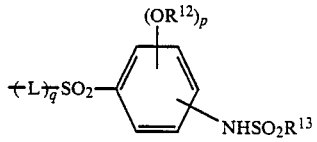

L is a divalent linking group; $R^{12}$ is an aliphatic group, an aryl group or a heterocyclic group; p is an integer of 1 to 2, provided that $R^{12}$ may be the same with or the different from each other when p is 2; $R^{13}$ is an aliphatic group, an aryl group, a heterocyclic group or

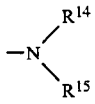

wherein $R^{14}$ and $R^{15}$ are each a hydrogen atom, an aliphatic group or an aryl group; and q is zero or one.

The typical examples of the magenta couplers of the invention will be given below.

M-1

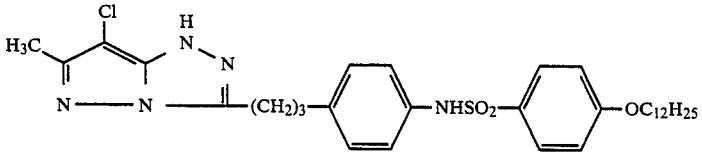

M-2

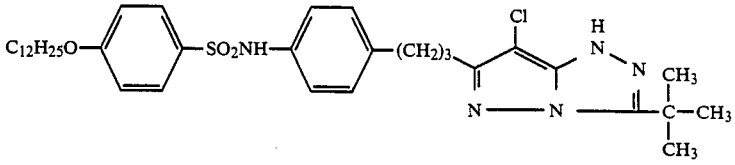

-continued
M-3
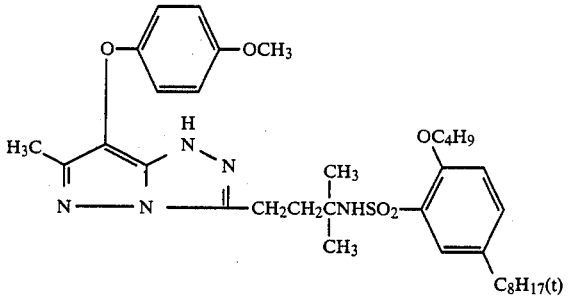
M-4
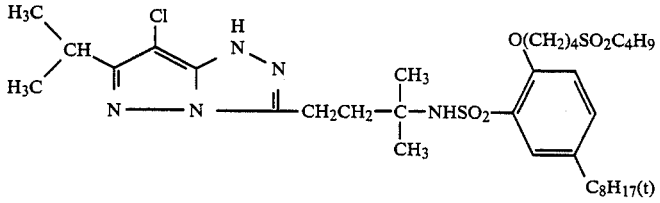
M-5
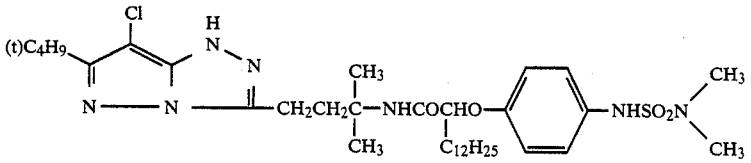
M-6
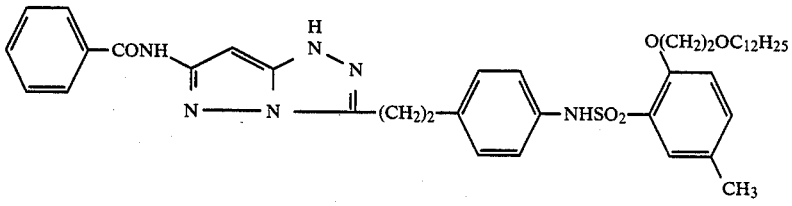
M-7
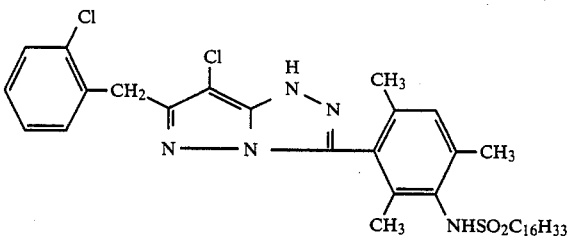
M-8
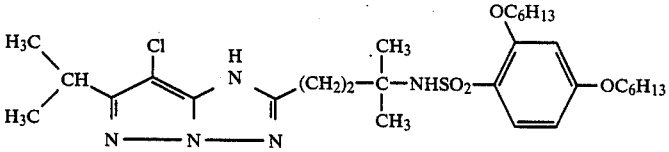
M-9
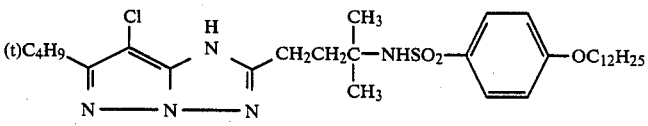
M-10
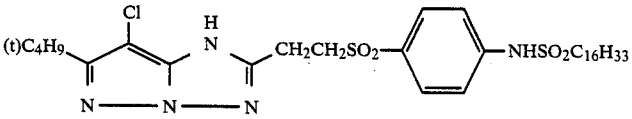

-continued
M-11
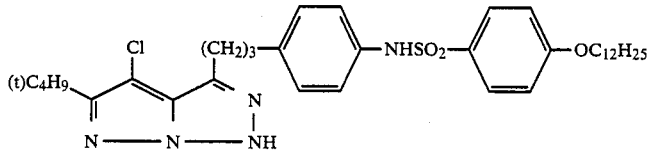
M-12
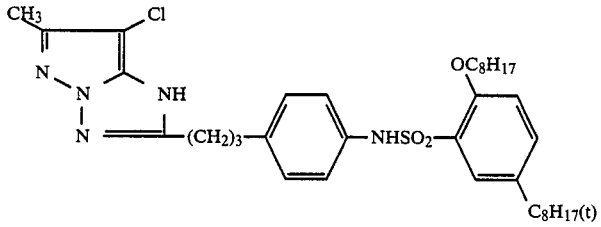
M-13
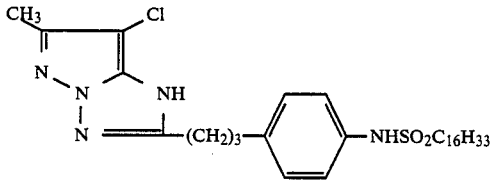
M-14
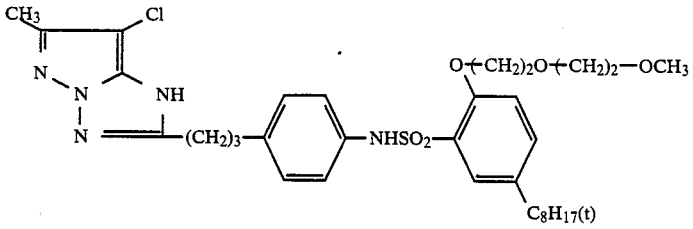
M-15
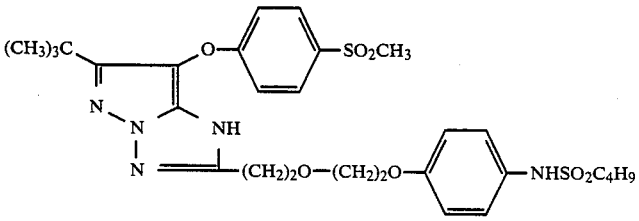
M-16
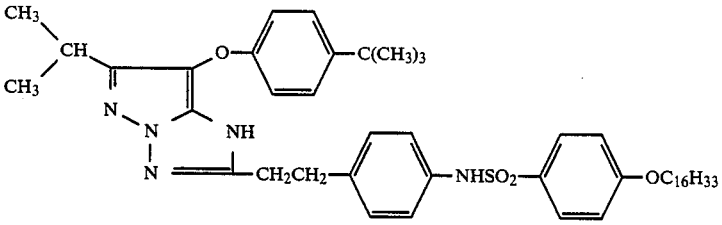
M-17
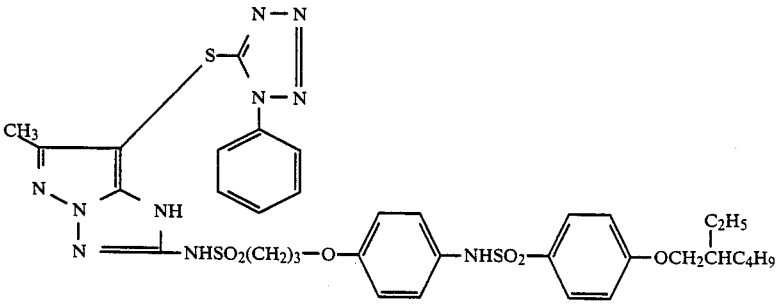

-continued
M-18
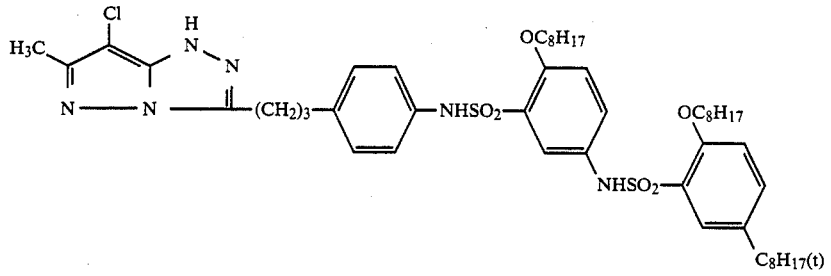
M-19
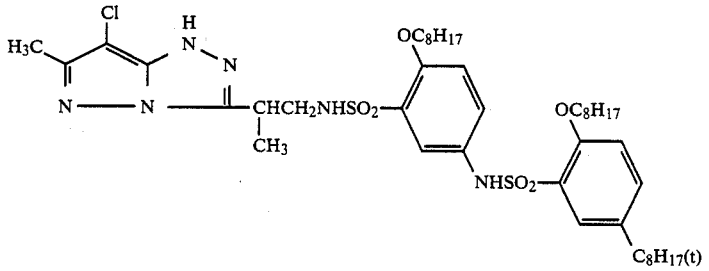
M-20
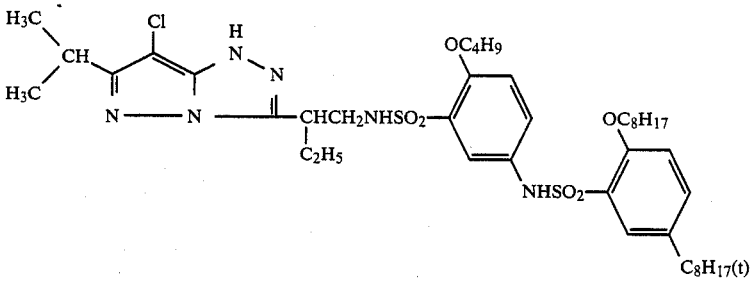
M-21
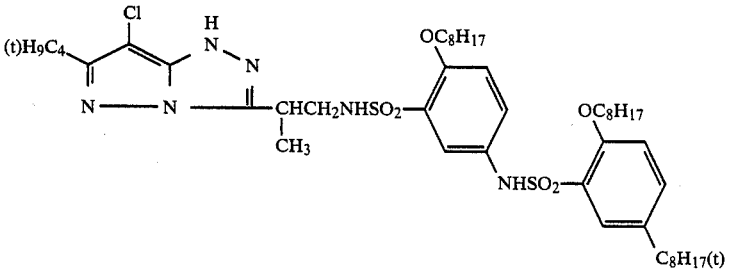
M-22
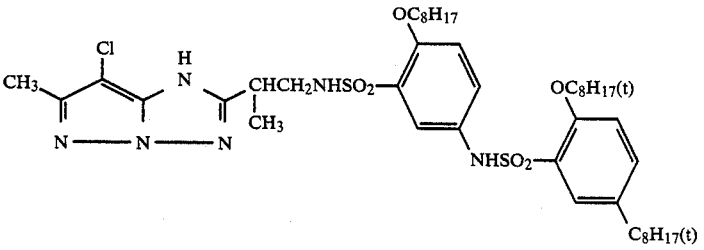
M-23
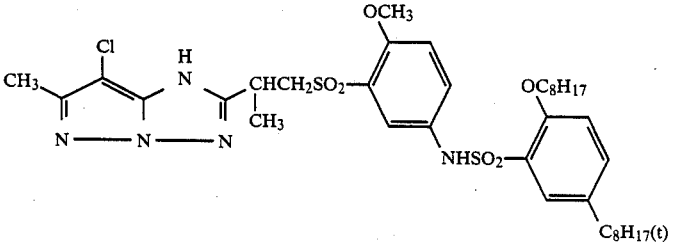

-continued
M-24
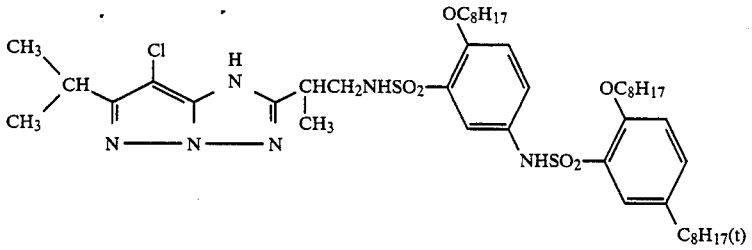
M-25
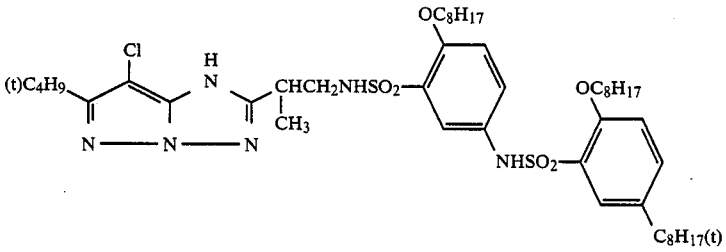
M-26
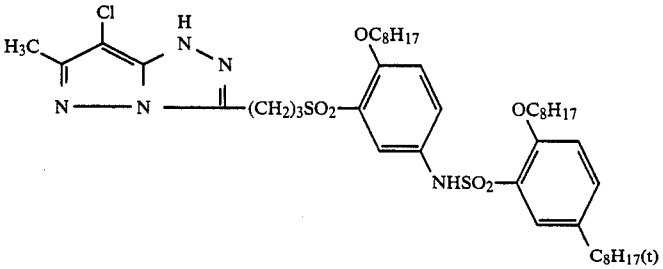
M-27
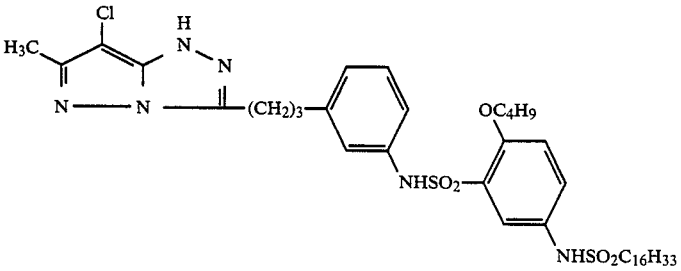
M-28
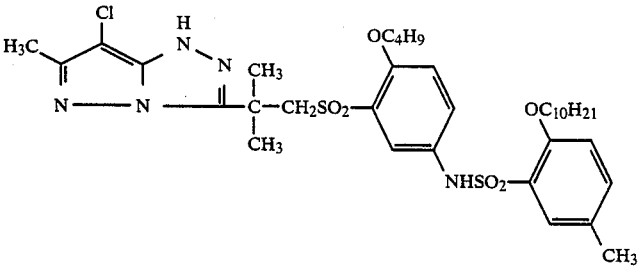
M-29
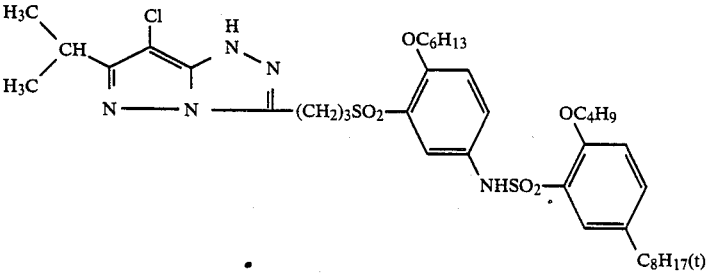

-continued

M-30

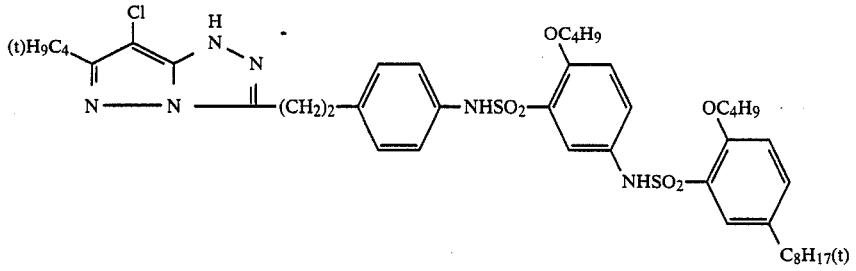

M-31

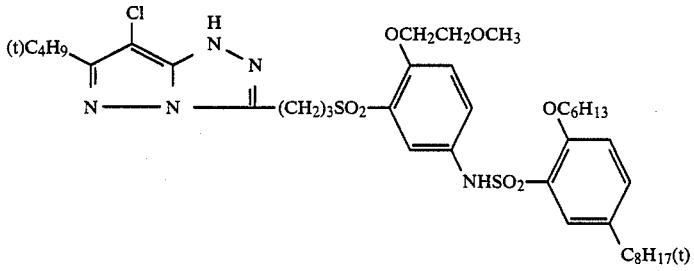

M-32

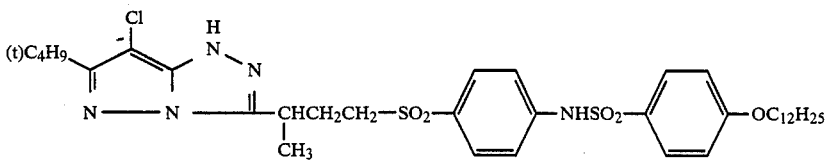

M-33

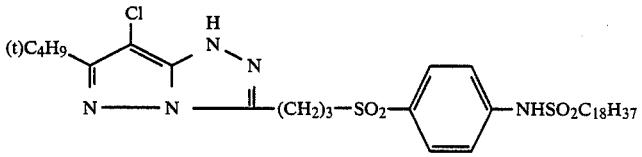

M-34

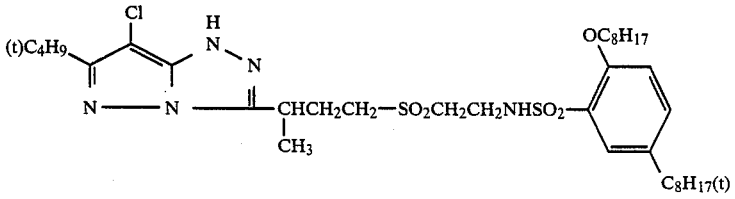

The magenta couplers of the invention can be synthesized with reference to Journal of the Chemical Society, Perkin I, 1977, pp. 2047–2052; U.S. Pat. No. 3,725,067; Japanese Patent O.P.I. Publication Nos. 99437-1984, 42045-1983, 162548-1984, 171956-1984, 33552-1985, 43659-1985, 172982-1985 and 190779-1985; and so forth.

The magenta couplers of the invention may commonly be used in an amount of from $1\times10^{-3}$ mol to 1.5 mol and, more preferably, from $1\times10^{-2}$ mol to 1 mol per mol of a silver halide used.

The magenta couplers of the invention may also be used together with the other kinds of magenta couplers in combination.

The magenta couplers of the invention are of the 1,2-pyrazole type. Therefore, they are very excellent in color reproducibility of dye image formed and, besides, they are high in color density of magenta dye images as well as satisfactorily high in a maximum density, when the silver halide photographic light-sensitive materials of the invention are rapidly processed, because they have at least one —$NHSO_2$— portion in a position other than the coupling active site.

When the silver halide photographic light-sensitive materials of the invention have a yellow dye image forming layer, the preferable yellow couplers contained in the yellow dye image forming layers should be a high-speed reaction type yellow coupler having a relative coupling reaction rate of not slower than 0.5.

The coupling reaction rate of a coupler may be determined in terms of a relative value in such a manner that two kinds of differently colored and clearly separable dye forming couplers M and N are mixed up together and then added into a silver halide emulsion and, after a color development is made, each of the dye contents of the resulted color image is measured.

In the terms that a maximum color density of coupler M is a (DM)max and a color density in an intermediate step is a DN, and a (DN)max and (DN) for coupler N, respectively, the ratio of reaction activity of both couplers, RM/RN, may be represented by the following equation:

$$\frac{RM}{RN} = \frac{\log\left(1 - \frac{DM}{(DM)\max}\right)}{\log\left(1 - \frac{DN}{(DN)\max}\right)}$$

That is to say, a coupling activity ratio, RM/RN, may be obtained in the following manner. A silver halide emulsion containing a mixture of couplers is exposed stepwise variously to light and color developed. The resulted several combinations of DM and DN are plotted on two rectangular co-ordinate axes in terms of $$\log\left(1 - \frac{DM}{(DM)\max}\right)$$

and $$\log\left(1 - \frac{DN}{(DN)\max}\right)$$

From the slope of the straight line obtained by plotting, the RM/RN value may be obtained.

With respect to various types of couplers, each of the RM/RN value thereof is obtained, in the same manner as mentioned above, by making use of a specific coupler N, it is possible to obtain the relative values of coupling reaction rates of the couplers, respectively.

In the invention, the RM/RN value obtained by making use of the following coupler as the above-mentioned coupler N is called the value of a relative coupling reaction rate.

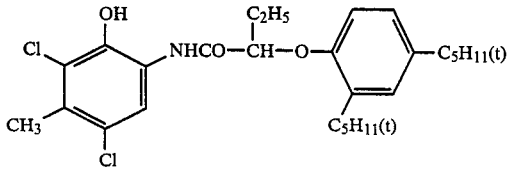

The color developer used in the above-mentioned color development is given below and the development was made at 38° C. and for 3 minutes 30 seconds.

| (Color developer composition) | |
|---|---|
| Benzyl alcohol | 15 ml |
| Ethylene glycol | 15 ml |
| Potassium sulfite | 2.0 g |
| potassium bromide | 0.7 g |
| Sodium chloride | 0.2 g |
| Potassium carbonate | 30.0 g |
| Hydroxylamine sulfate | 3.0 g |
| Polyphosphoric acid (TPPS) | 2.5 g |
| 3-methyl-4-amino-N—ethyl-N—(β-methanesulfonamidoethyl)-aniline sulfate | 5.5 g |
| Optical brightening agent (4,4'-diaminostilbenedisulfonic acid derivative) | 1.0 g |
| Potassium hydroxide | 2.0 g |
| Water to make in total | 1 liter |
| pH to be adjusted to | pH 10.20 |

High-speed reaction type yellow couplers preferably used in the invention are represented by hte following formula [Y]:

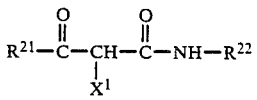

Formula [Y]

wherein $R^{22}$ is an alkyl or aryl group; $R^{22}$ is an aryl group; and $X^1$ is a hydrogen atom or a group capable of beling split off in the course of a color development reaction.

The groups represented by $R^{21}$ include, for example, a straight-chained or branched alkyl group such as a butyl group or an aryl group such as a phenyl group and, more preferably, an alkyl group especially a t-butyl group.

The groups represented by $R^{22}$ include, for example, an aryl group preferably, a phenyl group.

The alkyl and aryl groups each represented by $R^{21}$ and $R^{22}$ are allowed to have a substituent, and the aryl groups represented by $R^{22}$ are preferably substituted with a halogen atom, an alkyl group or the like.

The groups represented by $X^1$ are preferably a group represented by the following formula [Y-1] or [Y-2] and, among those represented by Formula [Y-1], the groups represented by the following formula [Y-1'] are particularly preferable.

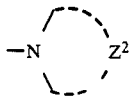

Formula [Y-1]

wherein $Z^2$ is a group of non-metal atoms capable of completing a 4 to 7 membered ring.

—O—$R^{23}$ Formula [Y-2]

where $R^{23}$ is an aryl, heterocyclic or acyl group and, preferably, an aryl group.

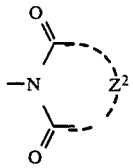

Formula [Y-1']

wherein $Z^2$ represents a group of non-metal atoms capable of completing a 4 to 6 membered ring together with

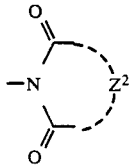

In the above-given Formula [Y], the preferable yellow couplers are represented by the following formula [Y']:

Formula [Y']

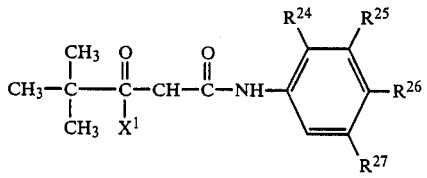

wherein $R^{24}$ is a hydrogen atom, a halogen atom or an alkoxy group and, more preferably, a halogen atom; $R^{25}$, $R^{26}$ and $R^{27}$ are a hydrogen atom, a halogen atom, an alkyl group, an alkenyl group, an alkoxy group, an aryl group, a carboxy group, an alkoxycarbonyl group, a carbamyl group, a sulfon group, a sulfamyl group, an alkylsulfonamido group, an acylamido group, a ureido group or an amino group, and it is preferred that $R^{25}$ and $R^{26}$ are hydrogen atoms and $R^{27}$ is an alkoxycarbonyl group, an acylamido group or an alkylsulfonamido amido group; and $X^1$ is a group synonymous with those represented by the aforegiven Formula [Y] and, preferably, those represented by the aforegiven formula [Y-1] or [Y-2] and, more preferably among these represented by Formula [Y-1], the groups represented by the aforegiven Formula [Y-1'].

An amount of the yellow couplers added is preferably from $2\times10^{-3}$ to $5\times10^{-1}$ mol and, more preferably, from $1\times10^{-2}$ to $5\times10^{-1}$ mol per mol of silver used.

The typical examples of such high-speed reaction type yellow couplers preferably used in the invention will be given below.

Formula [A-1]

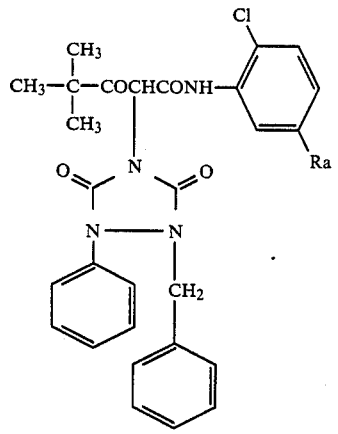

| Compound No. | Ra | RM/RN |
|---|---|---|
| Y-1 | 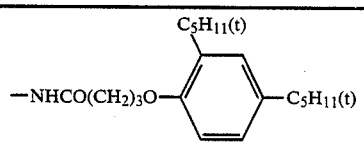 | 0.80 |
| Y-2 | 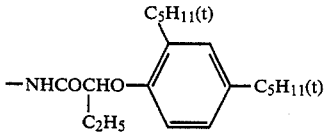 | 0.84 |
| Y-3 | $-SO_2NHC_{12}H_{25}(n)$ | 1.01 |
| Y-4 | $-COOCH(CH_3)COOC_{12}H_{25}(n)$ | 1.45 |
| Y-5 | 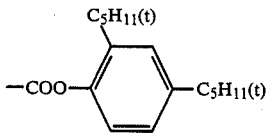 | 1.03 |
| Y-6 | $-NHCO(CH_3)CHCH_2SO_2C_{12}H_{25}$ | 0.95 |
| Y-7 | 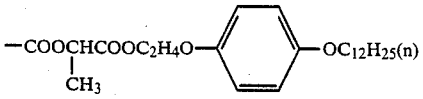 | 1.28 |

-continued
| | | |
|---|---|---|
| Y-11 | $-COOC_{12}H_{25}(n)$ | 1.32 |
| Y-13 | $-COOCH(C_4H_9(i))COOC_{12}H_{25}(n)$ | 1.48 |
Formula [A-2]
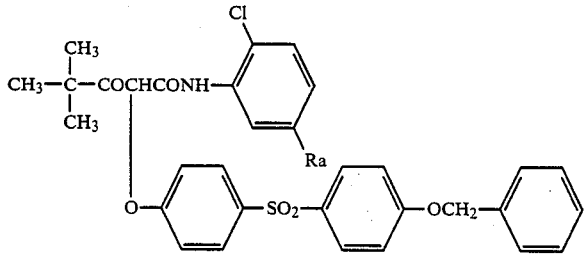
| Compound No. | Ra | RM/RN |
|---|---|---|
| Y-8 | $-NHCO(CH_2)_3O-C_6H_3(C_5H_{11}(t))-C_5H_{11}(t)$ | 0.65 |
| Y-9 | $-NHCOCH(C_2H_5)O-C_6H_3(C_5H_{11}(t))-C_5H_{11}(t)$ | 0.92 |
Formula [A-3]
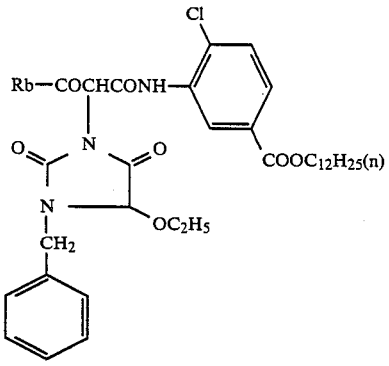
| Compound No. | Rb | RM/RN |
|---|---|---|
| Y-10 | $-C(CH_3)_3$ | 1.48 |
| Y-12 | $-C_6H_4-OCH_3$ | 1.46 |

-continued (Y-14) 1.1

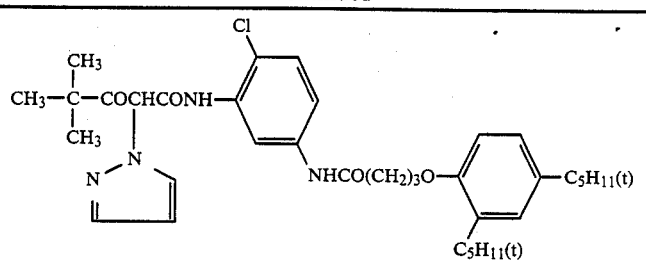

(Y-15) 0.94

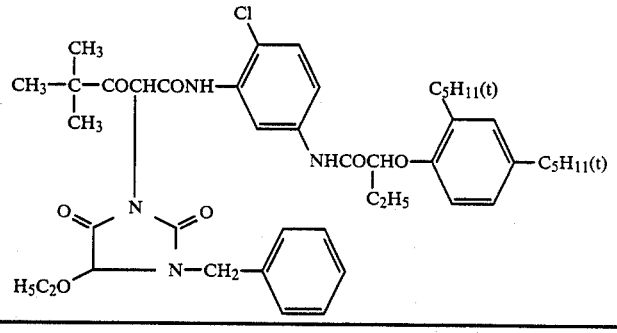

In the case of using the above-mentioned high-speed reaction type yellow couplers in a yellow dye image forming layer of the silver halide photographic light-sensitive materials of the invention, the resulting yellow dye images can be high in color density and satisfactory in maximum density when they are rapidly processed.

In the silver halide photographic light-sensitive materials of the invention, it is allowed to arbitrarily use the additives such as an antifogging agent, a hardener, a plasticizer, a latex, a surface active agent, an anticolor-fogging agent, a matting agent, a lubricant, an antistatic agent and so forth.

In a variety of color development processes, images can be formed on the silver halide photographic light-sensitive materials of the invention.

In the invention, the color developing agents used in a color developer include, for example, an aminophenol or a p-phenylenediamine derivative which is widely used in various color photographic processes.

The color developers applied for processing the silver halide photographic light-sensitive materials of the invention may be added with the compounds as the well-known components thereof, as well as with the above-mentioned aromatic primary amine type color developing agent. Even with a system not containing any benzyl alcohol that is in an environmental pollution load problems, the advantages of the invention can be enjoyed.

The pH value of a color developer is normally not lower than 7 and, most popularly, from about 10 to 13.

The developing temperature is normally not lower than 15° C. and, more popularly, within the range of from 20° C. to 50° C. However, a rapid processing is preferably carried out at a temperature of not lower than 30° C. In general, the color developing time of the invention aiming at a rapid processing is within the range of, preferably, from 20 to 60 seconds and, more preferably, from 30 to 50 seconds; the conventional developing time is from 3 to 4 minutes though.

After a development is made, the silver halide photographic light-sensitive materials of the invention are treated in a bleaching step and a fixing step. These bleaching and fixing steps may be made at the same time.

After completing the fixing step, a washing step is ordinarily carried out. As for the substitution of the washing step, a stabilizing step may be carried out or may be carried out the two steps together.

As described above, even in the case of rapidly processing the silver halide photographic light-sensitive materials of the invention, the cyan dyes are excellent in both color developability and spectral absorption property and a high image quality cyan dye image having an excellent antifading property can be formed. They are therefore suitable for a rapid processing.

EXAMPLES

The typical examples of the invention will now be described below.

EXAMPLE 1

According to the composition shown in Table-1 and to the preparation processes shown below, a variety of coupler dispersion solutions were prepared. The resulted dispersion solutions were mixed up with 500 g of a red-sensitive silver halide emulsion prepared in the following process. To the resulted mixture was added with 10 ml of a 10% solution of sodium salt of 2,4-dihydroxy-6-chloro-S-triazine as a hardener. The resulted matter was coated over to a poly-ethylene-coated paper support and dried up. Thus, Samples 1 through 30 were prepared.

Preparation of coupler dispersion solution

Ten (10) of the cyan coupler relating to the invention shown in Table-1, 5 g of the compound represented by Formula [I] relating to the invention and 5 g of the compound represented by Formulas (II-1 through 3) relating to the invention were dissolved in 30 ml of the mixed solvent containing 5 ml of dioctyl phthalate and 30 ml of ethyl acetate. The resulted solution was added to 300 ml of a 5% aqueous gelatin solution containing sodium dodecylbenzene sulfonate and was then dispersed by supersonic homogenizer. Thus, a coupler dispersion solution was prepared.

Preparation of silver halide emulsions

EM-1

An aqueous silver nitrate solution and an aqueous sodium chloride solution were added with stirring into an aqueous inert-gelatin solution in a double-jet method. The controls were so made as to be at 60° C., pH=3.0 and pAg=7.8. Next, a desalting was made and, thus, EM-1 was prepared. EM-1 was a cubic monodisperse type silver chloride emulsion having an average grain size of 0.5 μm.

EM-2

An aqueous silver nitrate solution and an aqueous halide solution (that was an aqueous mixture solution of potassium bromide and sodium chloride) were added and mixed into an aqueous inert-gelatin solution in a double-jet method. The controls were so made as to be at 60° C., pH=3.0 and pAg=7.8 in accordance with the method described in Japanese Patent O.P.I. Publication No. 45437-1984. Next a desalting was made and, thus, EM-2 was prepared. EM-2 was a monodisperse type emulsion having an average grain size of 0.5 μm and comprising tetradecahedral silver chlorobromide grains having a silver bromide content of 90 mol%.

Next, EM-1 and EM-2 each were chemically sensitized under the following conditions, so that the red-sensitive silver halide emulsions EMR-1 and EMR-2 were prepared, respectively. However, as far as compound [S] was concerned, it was added thereinto when each of the chemical sensitization was completed.

Sulfur sensitizer: Sodium thiosulfate, 2.5 mg/mol of AgX

Chloroauric acid: $5\times10^{-5}$ mol/mol of AgX

Spectral sensitizing dye: D-1, 100 mg/mol of AgX

Compound [S]: $1.5\times10^{-3}$ mol/mol of AgX

Temperature: 60° C.

Processing time: 60 minutes

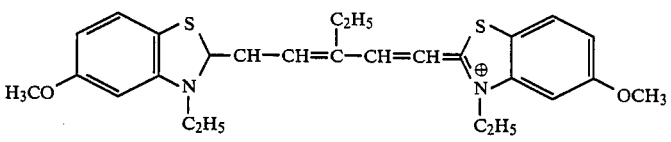

Spectral sensitizing dye [D-1]

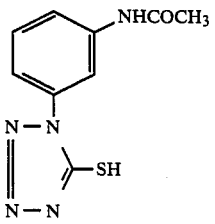

Compound [S]

The resulted samples were exposed wedgewise to light in an ordinary manner and were then processed in the following manner.

[Processing step A]

| | Temperature | Time |
|---|---|---|
| Color developing: | 34.7 ± 0.3° C. | 50 sec. |
| Bleach-fixing: | 34.7 ± 0.5° C. | 50 sec. |
| Stabilizing: | 30 to 40° C. | 90 sec. |
| Drying: | 60 to 64° C. | 60 sec. |

-continued

| | |
|---|---|
| (Color developer) | |
| Pure water | 800 ml |
| Ethylene glycol | 10 ml |
| N,N—diethylhydroxyiamine | 10 g |
| Potassium chloride | 2 g |
| N—ethyl-N—β-methanesulfonamidoethyl-3-methyl-4-aminoaniline sulfate | 5 g |
| Sodium tetrapolyphosphate | 2 g |
| Potassium carbonate | 30 g |
| Optical brightening agent (i.e., 4,4'-diaminostilbenedisulfonic acid derivative) | 1 g |
| Pure Water to make | 1,000 cc |
| pH to be adjusted to | pH 10.08 |
| (Bleach-fixer) | |
| Ferric ammonium ethylenediamine tetraacetate, dihydrate | 60 g |
| Ethylenediaminetetraacetic acid | 3 g |
| Ammonium thiosulfate (a 70% solution) | 100 ml |
| Ammonium sulfite (a 40% solution) | 27.5 ml |
| pH to be adjusted with potassium carbonate of glacial acetic acid to | pH 7.1 |
| Water to make | 1,000 cc |
| (Stabilizer) | |
| 5-chloro-2-methyl-4-isothiazoline-3-one | 1 g |
| 1-hydroxyethylidene-1,1-diphosphoric acid | 2 g |
| Water to make | 1,000 cc |
| pH to be adjusted with sulfuric acid or potassium hydroxide to | pH 7.0 |

[Processing step B]

| | | |
|---|---|---|
| Color developing | 3 min 30 sec | 33° C. |
| Bleach-fixing | 1 min 30 sec | 33° C. |
| Washing | 3 min | 33° C. |

| | |
|---|---|
| (Color developer) | |
| N—ethyl-N—β-methanesulfonamidoethyl-3-methyl-4-aminoaniline sulfate | 4.9 g |
| Hydroxylamine sulfate | 2.0 g |
| Potassium carbonate | 25.0 g |
| Sodium bromide | 0.6 g |
| sodium sulfite, anhydrous | 2.0 g |
| Benzyl alcohol | 13.0 ml |
| Polyethylene glycol (average polymerization degree: 400) | 3.0 ml |
| Water to make | 1,000 cc |
| pH to be adjusted with sodium hydroxide to | pH 10.0 |
| (Bleach-fixer) | |
| Sodium iron ethylenediaminetetraacetate | 6.0 g |
| Ammonium thiosulfate | 100.0 g |
| Sodium bisulfite | 10.0 g |
| Sodium metabisulfite | 3.0 g |
| Water to make | 1,000 cc |
| pH to be adjusted with aqueous ammonia | to pH 7.0 |

The samples processed were tested for color developability (Dmax), spectral absorption properties (λmax, DG) of color forming dyes, light-fastness and dark preservability. The results thereof are shown in Table-1.

Color developability test

Each of the processed samples was tested for its maximum reflection density (Dmax).

Spectral absorption property of color forming dye

At the point of time when the density of a cyan dye image was at 1.0, the maximum absorption wavelength (λmax) and the density of 550 nm (DG) were measured.

Light-fastness test

At the point of time when the processed samples on an under-glass type outdoor exposure table were exposed to sunlight for 15 days, the ratio (%) of residual dye image was obtained with respect to the initial density of 1.0.

Dark preservability test

Samples were stored in the dark at 85° C. and 60% RH for 21 days, and the rate (%) of residual dye image was obtained with respect to the initial density of 1.0.

TABLE 1

| | Composition | | | | | | Result | | | | |
|---|---|---|---|---|---|---|---|---|---|---|---|
| | | Cyan coupler | | | | | | Spectral absorption | | | |
| Sample No. | AgX emulsion (AgC content) | Formula [C-1] Mol ratio in ( ) | Formula [C-2] Mol ratio in ( ) | Compound of Formula [I] | Compound of Formulas [IIa to IIc] | Processing step | Color developability (Dmax) | (λmax) (nm) | ($D_G$) | Light-fastness | Dark preservability |
| 1 (Comp.) | EMR-2 (10 mol %) | — | C-23 (10) | — | — | B | 2.45 | 656 | 0.466 | 84 | 69 |
| 2 (Comp.) | EMR-2 (10 mol %) | C-15 (4) | C-23 (6) | — | — | B | 2.20 | 650 | 0.497 | 73 | 90 |
| 3 (Comp.) | EMR-2 (10 mol %) | C-15 (4) | C-23 (6) | — | IIa-13 | B | 1.97 | 650 | 0.497 | 85 | 91 |
| 4 (Comp.) | EMR-2 (10 mol %) | C-15 (4) | C-23 (6) | A-7 | — | B | 2.43 | 656 | 0.465 | 72 | 68 |
| 5 (Comp.) | EMR-2 (10 mol %) | C-15 (4) | C-23 (6) | A-7 | IIa-13 | B | 2.21 | 656 | 0.465 | 85 | 90 |
| 6 (Comp.) | EMR-1 (100 mol %) | — | C-23 (10) | — | — | A | 2.46 | 656 | 0.446 | 85 | 69 |
| 7 (Comp.) | EMR-1 (100 mol %) | C-15 (4) | C-23 (6) | — | — | A | 2.22 | 650 | 0.495 | 73 | 89 |
| 8 (Comp.) | EMR-1 (100 mol %) | C-15 (4) | C-23 (6) | — | IIa-13 | A | 1.98 | 650 | 0.495 | 86 | 91 |
| 9 (Comp.) | EMR-1 (100 mol %) | C-15 (4) | C-23 (6) | A-7 | — | A | 2.23 | 656 | 0.445 | 72 | 68 |
| 10 (Inv.) | EMR-1 (100 mol %) | C-15 (4) | C-23 (6) | A-7 | IIa-13 | A | 2.48 | 656 | 0.445 | 86 | 90 |
| 11 (Inv.) | EMR-1 (100 mol %) | C-15 (4) | C-33 (6) | A-7 | IIa-13 | A | 2.47 | 656 | 0.445 | 86 | 91 |
| 12 (Inv.) | EMR-1 (100 mol %) | C-13 (4) | C-33 (6) | A-7 | IIa-13 | A | 2.47 | 655 | 0.447 | 84 | 90 |
| 13 (Inv.) | EMR-1 (100 mol %) | C-2 (4) | C-33 (6) | A-7 | IIa-13 | A | 3.43 | 655 | 0.449 | 83 | 90 |
| 14 (Inv.) | EMR-1 (100 mol %) | C-13 (4) | C-23 (6) | A-7 | IIa-13 | A | 3.46 | 656 | 0.445 | 86 | 91 |
| 15 (Inv.) | EMR-1 (100 mol %) | C-2 (4) | C-23 (6) | A-7 | IIa-13 | A | 3.43 | 656 | 0.447 | 85 | 90 |
| 16 (Inv.) | EMR-1 (100 mol %) | C-7 (4) | C-23 (6) | A-7 | IIa-13 | A | 3.49 | 655 | 0.448 | 84 | 89 |
| 17 (Inv.) | EMR-1 (100 mol %) | C-15 (4) | C-23 (6) | A-1 | IIa-13 | A | 3.47 | 655 | 0.446 | 85 | 90 |
| 18 (Inv.) | EMR-1 (100 mol %) | C-15 (4) | C-23 (6) | A-18 | IIa-13 | A | 3.47 | 655 | 0.446 | 85 | 90 |
| 19 (Inv.) | EMR-1 (100 mol %) | C-15 (4) | C-23 (6) | A-23 | IIa-13 | A | 3.46 | 655 | 0.447 | 85 | 89 |
| 20 (Inv.) | EMR-1 (100 mol %) | C-15 (4) | C-23 (6) | A-30 | IIa-13 | A | 3.47 | 655 | 0.446 | 84 | 89 |
| 21 (Inv.) | EMR-1 (100 mol %) | C-15 (4) | C-23 (6) | A-49 | IIa-13 | A | 3.46 | 655 | 0.447 | 85 | 89 |
| 22 (Inv.) | EMR-1 (100 mol %) | C-15 (4) | C-23 (6) | A-40 | IIa-13 | A | 3.46 | 655 | 0.446 | 85 | 89 |
| 23 (Inv.) | EMR-1 (100 mol %) | C-15 (4) | C-23 (6) | A-42 | IIa-13 | A | 3.45 | 655 | 0.446 | 84 | 90 |
| 24 (Inv.) | EMR-1 (100 mol %) | C-15 (4) | C-23 (6) | A-43 | IIa-13 | A | 3.46 | 655 | 0.446 | 84 | 89 |
| 25 (Inv.) | EMR-1 (100 mol %) | C-15 (4) | C-23 (6) | A-46 | IIa-13 | A | 3.47 | 655 | 0.447 | 85 | 89 |
| 26 (Inv.) | EMR-1 (100 mol %) | C-15 (4) | C-23 (6) | A-40 | IIa-13 | A | 3.47 | 655 | 0.446 | 85 | 90 |
| 27 (Inv.) | EMR-1 (100 mol %) | C-15 (4) | C-23 (6) | A-40 | IIa-12 | A | 3.45 | 655 | 0.446 | 84 | 89 |
| 28 (Inv.) | EMR-1 (100 mol %) | C-15 (4) | C-23 (6) | A-40 | IIa-7 | A | 3.45 | 655 | 0.466 | 84 | 89 |
| 29 (Inv.) | EMR-1 (100 mol %) | C-13 (4) | C-23 (6) | A-40 | IIb-12 | A | 3.43 | 654 | 0.448 | 84 | 89 |
| 30 (Inv.) | EMR-1 (100 mol %) | C-13 (4) | C-33 (6) | A-40 | IIb-12 | A | 3.42 | 654 | 0.448 | 84 | 89 |

As is obvious from the results shown in Table-1, in the case that the samples containing any other silver halide emulsion than those of the invention were processed in the ordinary processing step [B], Sample No. 2 containing the cyan coupler having Formula [C-2] and the cyan coupler having Formula [C-1] in combination was improved in dark preservability more than Sample No. 1 containing the cyan coupler having Formula [C-2] solely. However, the color developability, spectral absorption property and light-fastness of Sample No. 2 were deteriorated.

Sample No. 3 was improved in light-fastness, because it contains the compound having one of Formulas [IIa to IIc] to improve light-fastness. However, the color developability thereof was deteriorated.

Sample No. 4 was improved in spectral absorption property, because it contains the compound having Formula [I] to improve the property. However, the dark preservability thereof was not improved.

Even if the compound having Formula [IIa to IIc] and the compound having Formula [I] were used in combination, no color developability could be improved.

Next, in the case that the samples containing the silver halide emulsion of the invention were processed in the rapid processing step [A], the results of Samples No. 5 through No. 9 were the same as those of Samples No. 1 through No. 4. On the other hand. In Samples No. 10 through No. 30 each having the constitution of the invention, the color developability thereof was not deteriorated and the spectral absorption property, light-fastness and dark preservability were also improved, so that they were suitable for rapid processing.

EXAMPLE 2

Samples No. 31 through No. 46 were prepared in the same constitution as that of Sample No. 10 prepared in Example 1, except that the silver chloride contents and processing steps of the silver halide emulsions were changed to those shown in Table-2. The tests were tried for the color developability having ever been tested in Example 1. The results are shown in Table-2, below.

TABLE 2

| Sample No. | Silver chloride content (mol %) | Processing step | Color developability (Dmax) |
|---|---|---|---|
| 10 (Inv.) | 100 | A | 2.48 |
| 31 (Inv.) | 99 | A | 2.48 |
| 32 (Inv.) | 98 | A | 2.48 |

TABLE 2-continued

| Sample No. | Silver chloride content (mol %) | Processing step | Color developability (Dmax) |
|---|---|---|---|
| 33 (Inv.) | 95 | A | 2.47 |
| 34 (Inv.) | 90 | A | 2.46 |
| 35 (Comp.) | 80 | A | 2.24 |
| 36 (Comp.) | 70 | A | 2.20 |
| 37 (Comp.) | 50 | A | 2.19 |
| 38 (Comp.) | 10 | A | 2.11 |
| 39 (Inv.) | 100 | B | 2.33 |
| 40 (Inv.) | 99 | B | 2.32 |
| 41 (Inv.) | 98 | B | 2.33 |
| 42 (Inv.) | 95 | B | 2.31 |
| 43 (Inv.) | 90 | B | 2.31 |
| 44 (Comp.) | 90 | B | 2.24 |
| 44 (Comp.) | 70 | B | 2.23 |
| 46 (Comp.) | 50 | B | 2.23 |
| 2 (Comp.) | 10 | B | 2.21 |

As is obvious from the results shown in Table-2, the color developability improvements were found in the rapid processing [A] from the constitution of the invention in which a silver halide having a silver chloride content of not lower than 90 mol% was used. With respect to the results of the spectral absorption property, light-fastness and dark preservability. Samles No. 31 through No. 38 were the same as Sample No. 10, and Samples No. 39 through No. 46 were the same as Sample No. 2, respectively.

EXAMPLE 3

In order from the side of a support comprising a polyethylene-coated paper, each of the layers given below was coated over to the support, so that the silver halide color photographic light-sensitive materials for multicolor use were prepared.

The 1st layer: A blue-sensitive silver chloride emulsion layer

The coating was so made as to be in the following coating weight; 8 mg/dm$^2$ of yellow coupler (*), 3 mg/dm$^2$, in terms of silver used, of the blue-sensitive silver chloride emulsion (Em. A) given below, 3 mg/dm$^2$ of a high boiling organic solvent (DNP), and 16 mg/dm$^2$ of gelatin.

The 2nd layer: An interlayer

The coating was so made as to be in the coating weight of 0.45 mg/dm$^2$ of a hydroquinone derivative (HQ-1) and 4 mg/dm$^2$ of gelatin.

The 3rd layer: A green-sensitive silver chloride emulsion layer

The coating was so made as to be in the following coating weight; 4 mg/dm$^2$ of magenta coupler (*), 4 mg/dm$^2$, in terms of silver used, of the green-sensitive silver chloride emulsion (Em. B) given below, 4 mg/dm$^2$ of a high boiling organic solvent (DOP), and 16 mg/dm$^2$ of gelatin.

The 4th layer: An interlayer

The coating was so made as to be in the following coating weight; 3 mg/dm$^2$ of a UV absorber (UV-1), 3 mg/dm$^2$ of another UV absorber (UV-2), 4 mg/dm$^2$ of a high boiling organic solvent (DNP), 0.45 mg/dm$^2$ of a hydroquinone derivative (HQ-1) and 14 mg/dm$^2$ of gelatin.

The 5th layer: A red-sensitive silver chloride emulsion layer

The coating was so made as to be in the following coating weight; 4 mg/dm$^2$ of cyan coupler (), 2 mg/dm$^2$ of a high boiling organic solvent (DOP), 2 mg/dm$^2$ of the compound () having Formula [I], 2 mg/dm$^2$ of the compound (**) having Formula [II-1 through 3], 3 mg/dm$^2$, in terms of silver used, of the red-sensitive silver chloride emulsion (Em. C or D) given below, and 14 mg/dm$^2$ of gelatin.

The 6th layer: An interlayer

The coating was so made as to be in the following coating weight; 2 mg/dm$^2$ of a UV absorber (UV-1), 2 mg/dm$^2$ of another UV absorber (UV-2), 2 mg/dm$^2$ of a high boiling organic solvent (DNP), and 6 mg/dm$^2$ of gelatin.

The 7th layer: A protective layer

Gelatin was so coated as to be in a coating weight of 9 mg/dm$^2$.

The compound (**) in the 5th layer is shown in Table-3.

The compounds designated by an asterisk * will be given below:

Yellow couplers

YC-1

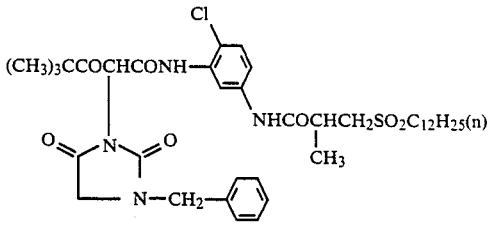

YC-2

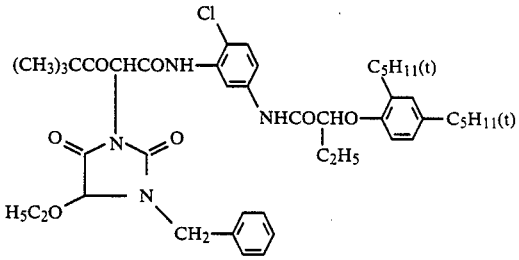

YC-3

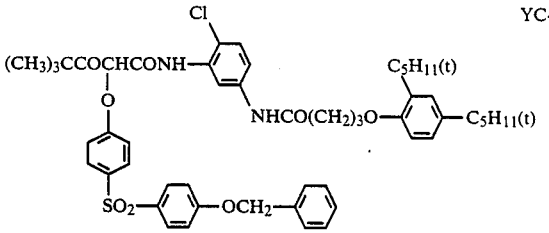

Magenta couplers

MC-1

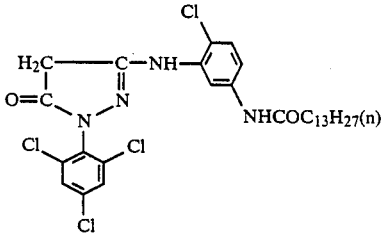

-continued

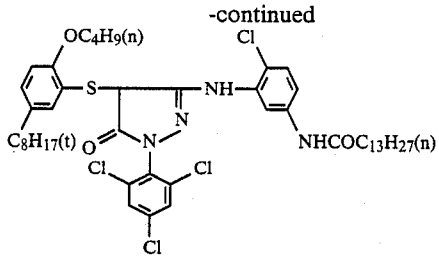

MC-2

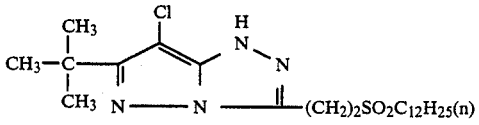

MC-3

UV absorbers (UV-1)

| Layer added | Name of Em | AgCl content (mol %) | Grain size (μm) |
|---|---|---|---|
| 1st layer | Em-A | 100 | 0.8 |
| 3rd layer | Em-B | 100 | 0.4 |
| 5th layer | Em-C | 100 | 0.4 |
| 5th layer | Em-D | 20 | 0.4 |

By making use of a sensitometer (Model KS-7, manufactured by Konishiroku Photo Ind. Co., Ltd.), the samples were exposed to red light through an optical wedge, and they were processed in the same manner as in Example 1.

The resulted cyan color developed samples were subjected to the same tests as in Example 1, except that the irradiation were applied for 35 days for the light-fastness tests.

The results are shown in Table-3, below.

TABLE 3

| | Composition | | | | | | | | Result Cyan dye image | | | | |
|---|---|---|---|---|---|---|---|---|---|---|---|---|---|
| | Coupler | | | | | | | | | | | | |
| | | | C | | | | | | | | | | |
| Sample No. | Y | M | Formula [C-1] Mol ratio in ( ) | Formula [C-2] | AgX em. in 5th layer | Compound of Formula [I] | Compound of Formulas [IIa to IIc] | Processing step | Color developability (Dmax) | Spectral absorption (λmax) (nm) | ($D_G$) | Light-fastness (Irradiated for 35 days) | Dark preservability |
| 47 (Comp.) | YC-1 | MC-1 | C-15 (4) | C-23 (6) | D | A-7 | IIa-13 | B | 2.19 | 656 | 0.468 | 82 | 91 |
| 48 (Comp.) | YC-1 | MC-1 | C-15 (4) | C-23 (6) | D | A-7 | IIa-13 | A | 2.28 | 656 | 0.460 | 83 | 90 |
| 49 (Comp.) | YC-1 | MC-1 | C-15 (4) | C-23 (6) | C | — | — | A | 2.23 | 650 | 0.494 | 70 | 89 |
| 50 (Comp.) | YC-1 | MC-1 | C-15 (4) | C-23 (6) | C | — | IIa-13 | A | 1.95 | 650 | 0.494 | 84 | 90 |
| 51 (Comp.) | YC-1 | MC-1 | C-15 (4) | C-23 (6) | C | A-7 | — | A | 2.21 | 656 | 0.446 | 68 | 89 |
| 52 (Inv.) | YC-1 | MC-1 | C-15 (4) | C-23 (6) | C | A-7 | IIa-13 | A | 2.48 | 656 | 0.446 | 84 | 91 |
| 53 (Inv.) | YC-2 | MC-1 | C-15 (4) | C-23 (6) | C | A-7 | IIa-13 | A | 2.48 | 656 | 0.446 | 84 | 91 |
| 54 (Inv.) | YC-3 | MC-1 | C-15 (4) | C-23 (6) | C | A-7 | IIa-13 | A | 2.48 | 656 | 0.446 | 84 | 91 |
| 55 (Inv.) | YC-1 | MC-2 | C-15 (4) | C-23 (6) | C | A-7 | IIa-13 | A | 2.48 | 656 | 0.446 | 84 | 91 |
| 56 (Inv.) | YC-1 | MC-3 | C-15 (4) | C-23 (6) | C | A-7 | IIa-13 | A | 2.48 | 656 | 0.446 | 84 | 91 |
| 57 (Inv.) | YC-2 | MC-2 | C-15 (4) | C-23 (6) | C | A-40 | IIa-13 | A | 2.47 | 655 | 0.449 | 83 | 90 |
| 58 (Inv.) | YC-2 | MC-2 | C-13 (4) | C-23 (6) | C | A-40 | IIa-13 | A | 2.46 | 654 | 0.450 | 83 | 90 |
| 59 (Inv.) | YC-2 | MC-2 | C-13 (4) | C-23 (6) | C | A-40 | IIa-13 | A | 2.46 | 654 | 0.451 | 83 | 89 |
| 60 (Inv.) | YC-2 | MC-2 | C-7 (4) | C-23 (6) | C | A-40 | IIa-13 | A | 2.47 | 654 | 0.450 | 83 | 90 |
| 61 (Inv.) | YC-2 | MC-2 | C-15 (5) | C-23 (5) | C | A-40 | IIa-13 | A | 2.46 | 655 | 0.449 | 83 | 90 |
| 62 (Inv.) | YC-2 | MC-2 | C-15 (3) | C-23 (7) | C | A-40 | IIa-13 | A | 2.47 | 655 | 0.449 | 83 | 90 |
| 63 (Inv.) | YC-2 | MC-2 | C-15 (4) | C-23 (6) | C | A-40 | IIb-12 | A | 2.45 | 655 | 0.449 | 82 | 89 |
| 64 (Inv.) | YC-2 | MC-2 | C-15 (4) | C-23 (6) | C | A-40 | IIc-7 | A | 2.45 | 655 | 0.449 | 83 | 90 |

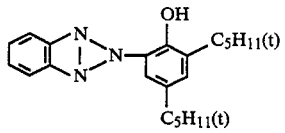

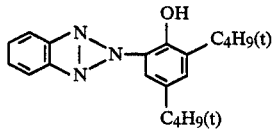

(UV-2)

Hydroquinone derivative

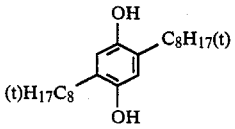

HQ-1

DNP = Dinonyl phthalate
DOP = Dioctyl phthalate

Silver halide emulsions Em-A through Em-D are as follows:

As is obvious from the results shown in Table-3, even in the multilayered systems, the results obtained from the monolayered system embodied in Example 1 can be reproduced. And, even in the rapid processes, Samples No. 52 through No. 64 each having the constitution of the invention display the excellent color developability and spectral absorption property of cyan dye images as well as the light-fastness and dark preservability. Further, even if yellow and magenta couplers are changed, there is no difference in the results.

EXAMPLE 4

The samples of this example were prepared in the same manner as in Sample No. 52 of Example 3, except that the magenta and cyan couplers and the compounds having Formulas [I] and [II-1 to 3] were changed from those of Sample No. 52 to those shown in Table-4.

By making use of a sensitometer (Model KS-7, manufactured by Konishiroku Photo Ind. Co., Ltd.), the samples were exposed to light through an optical wedge and were then processes in the same manner as in Example 3.

Regarding the color dye images obtained through the above process, the color developability (Dmax), the spectral absorption properties (λmax, $D_G$ and $D_B$) of the cyan dye, the spectral absorption property ($D_B$) of the magenta dye and the dark preservability were tested in the following methods. The results obtained are shown in Table-4, below.

Color developability test

The maximum density (Dmax) of the resulted color dye images was measured through blue, green and red light, ($D_{MB}$, $D_{MG}$ and $D_{MR}$), respectively. Thereby, the color developability of each sample was evaluated.

Spectral absorption property of cyan dye image

By making use of a color analyzer (Model 607 manufactured by Hitachi, Ltd.) and standardizing the maximum density of the absorption spectra in the visible area as 1.0, the absorption spectra of the cyan dye images were measured. Taking the maximum absorption wavelength (λmax), the sub-absorption density ($D_G$) at 550 nm and the sub-absorption density ($D_B$) at 420 nm at that time of the measurement, the spectral absorption property of cyan dye image was evaluated.

Spectral absorption property of magenta dye image

This was measured in the same manner as in the cyan dye image. Taking the sub-absorption density ($D_B$) at 430 nm as the color purity criterion, the spectral absorption property of the magenta dye image was evaluated.

Dark preservability test

The processed samples were stored for 20 days in the dark maintained at constant temperature of 85° C. and relative humidity of 60%. The residual density of the cyan dye image was then obtained from the image portion having had the initial density of 1.0.

TABLE 4

| | Composition | | | | | | | |
|---|---|---|---|---|---|---|---|---|
| | Coupler | | | | | | | |
| | | | C | | | | | |
| Sample No. | Y | M | Formula [C-1] | Formula [C-2] Mol ratio in ( ) | AgX em. in 5th layer | Compound of Formula [I] | Compound of Formulas [IIa to IIc] | Processing step |
| 65 (Comp.) | YC-1 | MC-1 | C-15 (6) | C-23 (4) | C | — | — | A |
| 66 (Comp.) | YC-1 | MC-1 | C-15 (6) | C-23 (4) | C | — | IIa-13 | A |
| 67 (Comp.) | YC-1 | MC-1 | C-15 (6) | C-23 (4) | C | A-7 | — | A |
| 68 (Inv.) | YC-1 | MC-1 | C-15 (6) | C-23 (4) | C | A-7 | IIa-13 | A |
| 69 (Inv.) | YC-1 | MC-2 | C-15 (6) | C-23 (4) | C | A-7 | IIa-13 | A |
| 70 (Inv.) | YC-1 | MC-1 | C-15 (6) | C-38 (4) | C | A-7 | IIa-13 | A |
| 71 (Inv.) | YC-1 | M-22 | C-15 (6) | C-23 (4) | C | A-7 | IIa-13 | A |
| 72 (Inv.) | YC-1 | M-22 | C-15 (6) | C-38 (4) | C | A-7 | IIa-13 | A |
| 73 (Inv.) | YC-1 | M-19 | C-15 (6) | C-23 (4) | C | A-7 | IIa-13 | A |
| 74 (Inv.) | YC-1 | M-19 | C-15 (6) | C-38 (4) | C | A-7 | IIa-13 | A |
| 75 (Comp.) | YC-1 | M-22 | C-15 (6) | C-23 (4) | C | — | — | A |
| 76 (Comp.) | YC-1 | M-22 | C-15 (6) | C-23 (4) | C | — | IIa-13 | A |
| 77 (Comp.) | YC-1 | M-22 | C-15 (6) | C-23 (4) | C | A-7 | — | A |

| | Result | | | | | | | | |
|---|---|---|---|---|---|---|---|---|---|
| | Color developability | | | Spectral absorption | | | | Light-fastness | |
| | | | | Cyan | | | Magenta | (Irradiated | Dark |
| Sample No. | DMB | DMG | DMR | λmax | DG | DB | DB | for 35 days) | preservability |
| 65 (Comp.) | 2.42 | 2.43 | 2.25 | 651 | 0.497 | 0.371 | 0.40 | 69 | 86 |
| 66 (Comp.) | 2.41 | 2.40 | 1.95 | 650 | 0.494 | 0.371 | 0.40 | 83 | 90 |
| 67 (Comp.) | 2.42 | 2.42 | 2.21 | 656 | 0.446 | 0.371 | 0.40 | 66 | 89 |
| 68 (Inv.) | 2.42 | 2.45 | 2.48 | 656 | 0.446 | 0.370 | 0.40 | 83 | 91 |
| 69 (Inv.) | 2.39 | 1.97 | 2.49 | 656 | 0.446 | 0.370 | 0.20 | 83 | 91 |
| 70 (Inv.) | 2.42 | 2.45 | 2.49 | 656 | 0.448 | 0.370 | 0.40 | 84 | 84 |
| 71 (Inv.) | 2.41 | 2.45 | 2.48 | 656 | 0.446 | 0.370 | 0.20 | 83 | 91 |
| 72 (Inv.) | 2.42 | 2.45 | 2.48 | 656 | 0.448 | 0.370 | 0.20 | 84 | 84 |
| 73 (Inv.) | 2.42 | 2.45 | 2.49 | 656 | 0.446 | 0.370 | 0.20 | 83 | 91 |
| 74 (Inv.) | 2.41 | 2.45 | 2.49 | 656 | 0.448 | 0.370 | 0.20 | 84 | 84 |
| 75 (Comp.) | 2.42 | 2.45 | 2.25 | 651 | 0.497 | 0.371 | 0.20 | 83 | 86 |
| 76 (Comp.) | 2.42 | 2.45 | 1.95 | 650 | 0.494 | 0.371 | 0.20 | 83 | 90 |
| 77 (Comp.) | 2.42 | 2.45 | 2.21 | 656 | 0.446 | 0.371 | 0.20 | 83 | 89 |

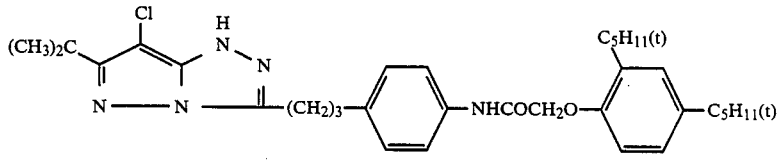

MC-2

Samples No. 68 through No. 74 were prepared according to the constitution of the invention, except that the magenta couplers were changed to MC-2, M-19 and M-22.

It was found to be preferable that these samples reproduced the results obtained in Example 3 and that, as compared with the sample containing MC-2, Samples No. 71 through No. 74 containing the magenta coupler M-19 or M-22 were more uniform in three-color balance and substantially less in irregular absorption of magenta dyes.

What is claimed is:

1. A silver halide photographic light-sensitive material comprising a support having thereon at least one silver halide emulsion layer comprising a silver halide grain comprising not less than 90 mol% of silver chloride, a cyan-dye forming coupler represented by the following formula [C-1], a cyan-dye forming coupler represented by the following formula [C-2], a non-color forming compound represented by the following formula [I], and a compound represented by the following formula [IIa], [IIb] or [IIc]:

Formula [C-1]

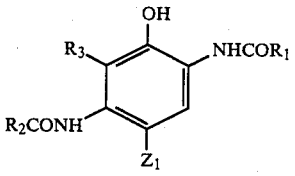

wherein $R_1$ and $R_2$ are an alkyl group, a cycloalkyl group, an alkenyl group, an aryl group or a heterocyclic group, respectively; $R_3$ is a hydrogen atom, a halogen atom, an alkyl group or an alkoxy group and may be form a ring together with $R_2$; and $Z_1$ is a group capable of being split off upon reaction with the oxidized product of a color developing agent, Formula [C-2]

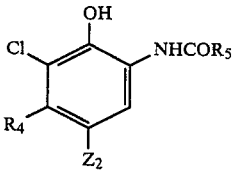

wherein $R_4$ is an alkylgroup; $R_5$ is a ballast group and $Z_2$ is a group capable of being split off upon reaction with the oxidized product of a color developing agent, Formula [I]

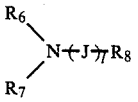

wherein $R_6$ and $R_7$ are a hydrogen atom, an alkyl group, an aryl group or a heterocyclic group, respectively; $R_8$ is an alkyl group, an aryl group, a cyano group or a heterocyclic group; J is an $-SO_2-$ group, a $-CO-$ group, an $-SO-$ group, a $-COO-$ group, a $-CS-$ group, an $$-SO_2\underset{\underset{R_9}{|}}{N}-$$

group or a $$-CON-$$
$$\quad\;\; |$$
$$\quad\;\; R_9$$

group, in which $R_9$ is a hydrogen atom, an alkyl group, an aryl group or a heterocyclic group; one of $R_6$ and $R_7$ may be bonded with $R_9$ to form a ring, and l is an integer of 0 or 1, Formula [IIa]

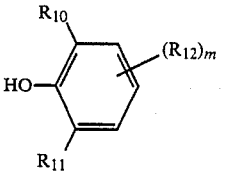

wherein $R_{10}$ and $R_{11}$ are an alkyl group, respectively; $R_{12}$ is an alkyl group, an —NHR′ group, an —SR′ group or a —COOR″ group, in which R′ is a monovalent organic group and R″ is a hydrogen atom or a monovalent organic group; and m is an integer of 0 to 3, Formula [IIb]

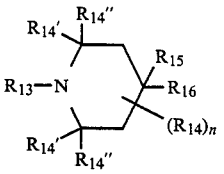

wherein $R_{13}$ is a hydrogen atom, a hydroxy group, an oxiradical, an $-SOR'_{13}$ group, an $-SO_2R'_{13}$ group, an alkyl group, an alkenyl group, an alkinyl group or a $-COR''_{13}$ group, in which $R'_{13}$ is an alkyl group, or an aryl group and $R''_{13}$ is a hydrogen atom or a monovalent organic group; $R_{14}$, $R'_{14}$ and $R''_{14}$ are are alkyl group, respectively; $R_{15}$ and $R_{16}$ are a hydrogen atom or an —COOR‴, respectively; and $R_{15}$ may be form a heterocyclic ring together with $R_{16}$, in which R‴ is a monovalent organic group; and n is an integer 0 to 4, Formula [IIc]

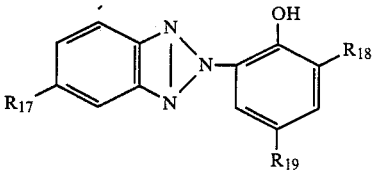

wherein $R_{17}$, $R_{18}$ and $R_{19}$ are a hydrogen atom, a halogen atom, a hydroxy group, a nitro group, an alkyl group, an alkoxy group, an aryl group or an alkenyl group, respectively.

2. The silver halide photographic light-sensitive material of claim 1, wherein the total amount of said cyan-dye forming coupler represented by the formula [C-1] and said cyan-dye forming coupler represented by the formula [C-2] in said silver halide emulsion layer is $1\times10^{-3}$ mol to 1 mol per mol of silver halide contained in said silver halide emulion layer.

3. The silver halide photographic light-sensitive material claim 2, wherein the total amount of said cyan-dye forming coupler represented by the formula [C-1] and said cyan-dye forming coupler represented by the formula [C-2] in said silver halide emulsion layer is $1\times10^{-2}$ mol to 8—$10^{-1}$ mol per mol of silver halide contained in said silver halide emulsion layer.

4. The silver halide photographic light-sensitive material of claim 1, wherein the molecular ratio of said cyan-dye forming coupler represented by thr formula [C-1] to said cyan-dye forming coupler represented by the formula [C-2] in said silver halide emulsion layer is 2:8 to 8:2.

5. The silver halide photographic light-sensitive material of claim 1, wherein an amount of said non-color forming compound represented by the formula [I] in said silver halide emulsion layer is 5 mol to 500 mol per mol of said cyan-dye forming couplers contained in said silver halide emulsion layer.

6. The silver halide photographic light-sensitive material of claim 5, wherein an amount of said non-color forming compound represented by the formula [I] in said silver halide emulsion layer is 10 mol to 300 mol per mol of said cyan-dye forming couplers contained in said silver halide emulsion layer.

7. The silver halide photographic light-sensitive material of claim 1, wherein an amount of said compound represented by the formula [IIa], [IIb] or [IIc] in said silver halide emulsion layer is 5 mol to 300 mol per mol of said cyan-dye forming couplers contained in said silver halide emulsion layer.

8. The silver halide photographic light-sensitive material of claim 7, wherein an amount of said compound represented by the formula [IIa], [IIb] or [IIc] in said silver halide emulsion layer is 10 ml to 200 mol per mol of said cyan-dye forming couplers contained in said silver halide emulsion layer.

9. The silver halide photographic light-sensitive material of claim 1, wherein said light-sensitive material comprises a silver halide emulsion layer comprising a magenta-dye forming coupler represented by the following formula [M-1]:

Formula [M-1]

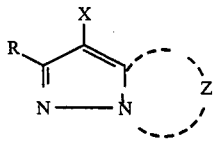

wherein Z is a group of non-metallic atoms necessary for completing a nitrogen-containing heterocyclic ring; X is a hydrogen atom or a group capable of being split off upon reaction with the oxidized product of a color developing agent and R is a hydrogen atom or a substituent, provided that R is a substituent or said heterocyclic ring represented by Z has a substituent and at least one of said substituent contains an —$NHSO_2$— group.

10. The silver halide photographic light-sensitive material of claim 9, wherein said substituent containing an —$NHSO_2$— group is a group represented by the following formula [A]:

Formula [A]

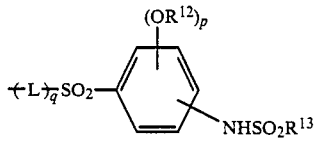

wherein L is a divalent linking group; $R^{12}$ is an aliphatic group, an aryl group or a heterocyclic group, and p is an integer of 1 or 2, two of $R^{12}$s may be the same or different from each other when p is 2; $R^{13}$ is an aliphatic group, an aryl group, a heterocyclic group or an $$-\underset{\underset{R^{15}}{|}}{N}-R^{14}$$

group, in which $R^{14}$ and $R^{15}$ are a hydrogen atom, an aliphatic group or an aryl group and q is an integer of 0 or 1.

11. The silver halide photographic light-sensitive material of claim 10, wherein an amount of said magenta-dye forming coupler represented by the formula [M-1] in said silver halide emulsion layer is $1\times10^{-3}$ mol to 1.5 mol per mol of silver halide contained said silver halide emulsion layer.

12. The silver halide photographic light-sensitive material of claim 10, wherein an amount of said magenta-dye forming coupler represented by the formula [M-1] in said silver halide emulsion layer is $1\times10^{-2}$ mol to 1 mol per mol of silver halide contained said silver halide emulsion layer.

13. The silver halide photographic light-sensitive material of claim 1, wherein said silver halide photographic material comprises a silver halide emulsion layer comprising a yellow-dye forming coupler having a relative coupling reaction rate of 0.5 or more.

14. The silver halide photographic light-sensitive material of claim 13, wherein said yellow-dye forming coupler is represented by the following formula [Y]:

Formula [Y]

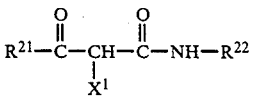

wherein $R^{21}$ is an alkyl group or an aryl group; $R^{22}$ is an aryl group and $X^1$ is a hydrogen atom or a group capable of being split off upon reaction with the oxidized product of a color developing agent.

15. The silver halide photographic light-sensitive material of claim 9, wherein said silver halide photographic light-sensitive material further comprises a silver halide emulsion layer containing a yellow-dye forming coupler having a coupling reaction rate of 0.5 or more.

* * * * *